US008833041B2

(12) United States Patent
May et al.

(10) Patent No.: US 8,833,041 B2
(45) Date of Patent: Sep. 16, 2014

(54) PACKAGING MACHINES SUITABLE FOR SHOT BAGS AND RELATED METHODS

(71) Applicant: Tipper Tie, Inc., Apex, NC (US)

(72) Inventors: Dennis J. May, Pittsboro, NC (US); Matthew D. Lowder, Durham, NC (US)

(73) Assignee: Tipper Tie, Inc., Apex, NC (US)

( * ) Notice: Subject to any disclaimer, the term of this patent is extended or adjusted under 35 U.S.C. 154(b) by 12 days.

(21) Appl. No.: 13/742,848

(22) Filed: Jan. 16, 2013

(65) Prior Publication Data

US 2013/0186261 A1 Jul. 25, 2013

Related U.S. Application Data

(60) Provisional application No. 61/588,230, filed on Jan. 19, 2012.

(51) Int. Cl.
*F42B 39/00* (2006.01)
*B65B 51/04* (2006.01)

(52) U.S. Cl.
CPC ..... *F24B 39/00* (2013.01); *F24B 33/0285* (2013.01); *F24B 33/0207* (2013.01)
USPC ..... 53/138.4; 53/58

(58) Field of Classification Search
CPC .. F24B 39/00; F24B 33/0285; F24B 33/0207; B65B 51/043; B65B 9/15; B65B 9/12; A22C 11/125
USPC ..... 53/138.4, 138.3, 138.2, 417, 469, 58, 53/502, 503, 66
See application file for complete search history.

(56) References Cited

U.S. PATENT DOCUMENTS

| | | | | |
|---|---|---|---|---|
| 2,879,149 | A | 7/1955 | Brown | |
| 3,216,307 | A | 11/1965 | Griffith | |
| 3,389,533 | A | 6/1968 | Tipper et al. | |
| 3,462,324 | A | 8/1969 | Grant et al. | |
| 3,499,259 | A | 3/1970 | Tipper et al. | |
| 3,731,625 | A | 5/1973 | Slawinski | |
| 4,107,903 | A * | 8/1978 | Wickersheim | 53/138.4 |
| 4,223,508 | A * | 9/1980 | Wells | 53/138.4 |
| 4,516,379 | A * | 5/1985 | Iain | 53/138.4 |
| 4,683,700 | A | 8/1987 | Evans et al. | |
| 5,161,347 | A | 11/1992 | May et al. | |
| 5,495,701 | A | 3/1996 | Poteat et al. | |
| 5,586,424 | A | 12/1996 | Chen et al. | |
| 5,596,165 | A | 1/1997 | Carney | |
| 5,782,067 | A | 7/1998 | Fuss et al. | |
| 5,918,447 | A * | 7/1999 | Hanten et al. | 53/551 |
| 6,035,606 | A * | 3/2000 | Bussey et al. | 53/138.4 |
| 6,920,728 | B2 | 7/2005 | Powers | |

(Continued)

OTHER PUBLICATIONS

International Search Report and Written Opinion for corresponding PCT Application No. PCT/US2013/021876, Date of mailing Oct. 15, 2013.

(Continued)

*Primary Examiner* — Andrew M Tecco
(74) *Attorney, Agent, or Firm* — Myer Bigel Sibley & Sajovec, P.A.

(57) ABSTRACT

Apparatus, systems, devices, methods and computer program products are configured to package products using automated movement of components that fill, then clip bags in a manner that is particularly suitable for packaging blasting powder and/or explosives in shot bags.

16 Claims, 19 Drawing Sheets

(56) References Cited

U.S. PATENT DOCUMENTS

| | | | | |
|---|---|---|---|---|
| 7,356,977 | B2 | 4/2008 | Griggs et al. | |
| 7,832,182 | B2 | 11/2010 | Griggs et al. | |
| 7,849,660 | B2 * | 12/2010 | Metzger | 53/58 |
| 8,232,483 | B2 * | 7/2012 | Murdter | 177/160 |
| 2011/0283658 | A1 | 11/2011 | May et al. | |

OTHER PUBLICATIONS

Tipper Tie® Technopack Alpina, Commercial Explosives Industrial Production Solutions, Product Brochure, 4 pages, Aug. 2011.

* cited by examiner

118
P
218
18c
18
22b
26c
126
22c
226
226r
$22_1$, $22_2$
30
CLIPPING

218r
$22_2$
$22_1$
FILLING

LOADING

| BAG LENGTHS FILLED | | | | | | BAG LENGTHS | | |
|---|---|---|---|---|---|---|---|---|
| | | | | | | | MEASUREMENTS | |
| DIAMETER (INCHES) | ACTUAL BAG LENGTH (INCHES) | BAG WEIGHT (INCHES) | PRODUCT DENSITY (g/cc) | THEORETICAL BAG LENGTH (m) | THEORETICAL BAG LENGTH (INCHES) | OUTER LINER (INCHES) | INNER LINER (INCHES) | OUTER FILM LENGTH TO FORM BAG (INCHES) |
| | | | | | | | | |
| 3 | 34 | 10 | 1.21 | 0.85 | 33.4 | 42.75 | 45.25 | 35.1 |
| 3.5 | TBD | 15 | 1.21 | 0.94 | 36.9 | 42.75 | 47.25 | 38.9 |
| 4 | 34 | 20 | 1.28 | 0.91 | 35.8 | 49 | 51 | 38.1 |
| 4.5 | 37.5 | 25 | 1.28 | 0.90 | 35.6 | 47.75 | 50.75 | 38.1 |
| 5 | 31.5 | 30 | 1.28 | 0.88 | 34.8 | 46 | 48 | 37.6 |
| 5.5 | 34.5 | 35 | 1.28 | 0.86 | 33.8 | 48 | 50.25 | 36.9 |
| 6 | 31.75 | 40 | 1.28 | 0.83 | 32.7 | 49 | 50.5 | 36.1 |
| 6.5 | 33 | 45 | 1.28 | 0.80 | 31.6 | 45.75 | 49.75 | 35.3 |
| 7 | 29 | 50 | 1.28 | 0.77 | 30.5 | 44.5 | 47.75 | 34.5 |
| 8 | 25.5 | 50 | 1.28 | 0.62 | 24.2 | 41 | 45.5 | 28.8 |

FIG. 11

PACKAGING MACHINES SUITABLE FOR SHOT BAGS AND RELATED METHODS

RELATED APPLICATIONS

This application claims priority to and the benefit of U.S. Provisional Application Ser. No. 61/588,230, filed Jan. 19, 2012, the contents of which are hereby incorporated by reference as if recited in full herein.

FIELD OF THE INVENTION

The present invention relates to apparatus, systems, methods and computer program products that package explosives in shot bags.

BACKGROUND OF THE INVENTION

Conventionally, in the production of explosives using shot bags, two operators cooperate to successively fill shot bags and place the filled shot bags in a clipper to clip the bags closed in a manner that reduces air pockets. The shot bags typically include an inner liner layer or bag comprising a polymer or some other suitable material and an outer layer of a different material, such as, for example, woven polypropylene. Prior to the clipping operation, an operator takes a filled bag, folds the inner liner inward, then guides the end portion of the bag into the clipper to apply a first clip. While the clipper gate is partially closed, the operator pulls the bag upward to try to further tighten the bag, then applies a second clip.

SUMMARY OF EMBODIMENTS OF THE INVENTION

Embodiments of the invention provide packaging systems, apparatus, methods and computer program products that can more efficiently produce shot bags and/or be less labor intensive.

Embodiments of the invention provide packaging systems and methods that can be used for other products.

Embodiments of the invention are directed to methods of filling shot bags. The methods include: (a) loading an empty shot bag to a packaging apparatus; then (b) deploying a clamp assembly with an open flow channel and at least one clamp in the packaging apparatus to clamp the loaded bag in position; (c) flowing explosive material into the loaded shot bag through the flow channel to fill the bag to a desired level; then (d) electronically closing clipper gates of a clipper residing under the at least one clamp to close against an upper end portion of the respective shot bag; then (e) automatically clipping at least one clip to the upper end portion of the filled bag while the clipper gates are closed.

The method can include automatically mechanically pulling a neck portion of the bag above the at least one clamp upward using the clamp assembly while the clipper gates are closed against a portion of the bag thereunder before automatically clipping.

The method can include, before the loading step, providing a sleeve that slidably extends a distance into the bag, below the clipper gates, then electronically raising the sleeve above the clipper gates before the closing step.

The method can include slidably inserting a pipe into the sleeve or inserting the sleeve into a pipe prior to the loading step, then carrying out the flowing step by pumping explosive material from a supply through the pipe and sleeve then into the bag.

The clamp assembly can include vertically translating lift actuators, laterally extending bag clamp actuators and a center tube. The center tube can define the open flow channel. The deploying can be carried out by laterally extending the bag clamp actuators toward each other to move at least first and second clamps against the center tube to clamp a wall of the bag therebetween. The automatically mechanically pulling can be carried out using the lift actuators.

The method can include attaching a sleeve lift collar that is connected to a sleeve lift actuator to the sleeve before the loading step, then actuating the sleeve lift cylinder to automatically lift the sleeve before the closing step.

The clamp assembly can include laterally extending bag clamp actuators with at least one respective grip member that reside across from each other with the open center channel extending between them. The laterally extending clamp actuators can be configured to extend to cause the grip members to clamp against a rigid member that defines the open channel thereby snugly holding the bag therebetween.

The method can include, before the loading step, providing a substantially vertical pipe that has upper and lower spaced apart ends, the upper end connected to a supply of pumpable explosive material and the lower end facing and/or residing in the bag, then raising the pipe above the clipper gates before the clipping step.

The method can include, before the clipping, automatically translating the clipper up and/or down while the clipper gates are closed against a gathered upper end portion of the filled bag.

The method can include pivoting a lower holding member residing under a lower end of the bag, to direct filled and clipped shot bags onto an adjacent underlying conveyor, then conveying the filled clipped shot bags away from the packaging apparatus.

Still other embodiments are directed to packaging apparatus. The apparatus includes: (a) a clipper having clipper gates that close together; (b) a bag clamp assembly that is in cooperating alignment with and that resides above the clipper gates; and (c) a controller in communication with the clipper and bag clamp assembly. The bag clamp assembly is configured to releasably hold a respective bag in the apparatus. The bag clamp-assembly includes an open center channel defining a target material flow channel. The bag clamp assembly is configured to releasably attach to an upper end portion of a bag to hold the bag for filling with the target material. The controller is configured to: (i) direct the bag clamp assembly to clamp the bag in position prior to filling, (ii) direct the clipper gates to close against an upper end portion of a respective bag after the bag has a desired amount of target material, then (iii) direct the clipper to apply at least one clip to the upper end portion of the bag while the clipper gates are closed.

The bag clamp assembly can include vertically translating lift actuators, laterally extending bag clamp actuators and a center tube. The center tube can define the open center channel. The bag clamp actuators can laterally extend toward each other to cause respective clamp members to clamp against the center tube to clamp a wall of the bag therebetween. A controller in communication with the lift actuators can be configured to direct the lift actuators to raise the bag clamp assembly a distance while the clip gates are closed.

The bag clamp assembly can include vertically translating lift actuators. The controller can be in communication with the lift actuators and is configured to direct the lift actuators to pull an upper portion of the bag upward while the clipper gates are closed before directing the clipper to apply at least one clip.

The apparatus can include a sleeve that slidably extends a distance down into the bag through the open center flow channel at a first loading position. The apparatus can be configured to automatically raise the sleeve above the clipper gates before closing the clipper gates prior to a clipping operation.

The apparatus can include a sleeve collar that is connected to the sleeve. The sleeve collar can be attached to a sleeve lift actuator. The controller can be in communication with the sleeve lift actuator, and for a respective bag filling operation, the controller directs the sleeve lift actuator to lower the sleeve to the first loading position, then directs the sleeve lift cylinder to automatically lift the sleeve above the clipper gates prior to directing the clipper gates to close.

The apparatus can include a housing that holds the clipper and bag clamp assembly. The bag clamp assembly can include laterally extending bag clamp actuators with grip members that reside across from each other with the open center flow channel extending between them. The laterally extending clamp actuators can be configured to extend to cause the grip members to clamp against a rigid member that defines the open channel, thereby snugly holding the bag therebetween.

The apparatus can include a substantially vertically oriented sleeve or pipe residing in the bag clamp assembly open flow channel with a lower end of the sleeve or pipe configured to reside in the open flow channel in the bag held by the bag clamp assembly. The bag can be oriented to be held substantially vertically by the bag clamp assembly and the sleeve and/or pipe can be configured to automatically translate between a bag loading position that is below the clipper gates to a bag pre-clip position that is above the clipper gates.

The bag clamp assembly can include clamp members that releasably attach serially interchangeable grip members of different size.

The controller is configured to direct the clipper to travel up or down after the clipper gates are closed prior to a applying a clip.

The apparatus can include a pipe that slidably engages the sleeve so that the sleeve can translate up and down relative to the pipe during a bag filling operation.

The sleeve can include an air inlet extending through at least one outer wall segment. The air inlet can be configured to reside inside a respective bag prior to a filling operation, then above the bag with the pipe wall occluding the air inlet during the filling operation while flowable material travels through the sleeve into the bag.

The apparatus can include a sleeve slidably engaged to a pipe. The sleeve can reside in the bag clamp assembly open channel inside the bag during a filling operation. The bag clamp assembly comprises bag clamp members with interchangeable grip members. The apparatus can be configured to serially interchangeably mount differently sized sleeves, pipes and grip members.

The apparatus can include a housing enclosing the clipper and bag clamp assembly with a front shield attached to an actuator that automatically moves up and down to allow access to the bag clamp assembly.

The apparatus can include a housing enclosing the clipper, bag clamp assembly and a lower holding member that resides under a respective bag in-line with the sleeve and pipe.

The apparatus can include a sleeve slidably engaged to a pipe that is adapted to be in fluid communication with a supply of pumpable flowable material. The sleeve can reside in the bag clamp assembly flow channel inside the bag during a filling operation. The bag clamp assembly can include a center tube that defines the flow channel. The bag clamp assembly can include first and second laterally extendable clamps that are configured to close against an outer wall of the tube while the sleeve slidably extends through the flow channel.

The apparatus can include a sleeve slidably engaged to a pipe that is adapted to be in fluid communication with a supply of pumpable flowable material. The sleeve can be configured to reside in an upper end of the bag during a filling operation. The bag clamp assembly can include: (i) upper and lower horizontally oriented platforms that are attached to each other and reside above the clipper gates that define a laterally extending space therebetween; (ii) a vertically oriented tube defining the flow channel held by the upper platform; (iii) first and second bag clamp actuators with rods that reside in the laterally extending space between the upper and lower platforms, the bag clamp actuators configured to translate substantially horizontally to move first and second clamp members between clamp and release positions, wherein the first and second clamp members can include grip segments that clamp against a bag held against an outer wall of the tube; and (iv) first and second bag clamp assembly lift actuators attached to the upper platform configured to pull against the bag when the clipper gates are closed.

The apparatus can include a sleeve slidably engaged to a pipe that is adapted to be in fluid communication with a supply of pumpable flowable material, the sleeve can be configured to reside in an upper end of the bag during a filling operation. The controller can be configured to direct a lift actuator connected the sleeve to lift the sleeve from a bag loading position that is below the clipper gates to a position above the clipper gates prior to activating the clipper.

The controller can be configured, in serial order, to (i) direct clipper gates to close against an upper end portion of the bag, (ii) direct the clipper to translate a distance downward against the upper end portion of the filled bag, (iii) direct the clipper to apply two clips substantially concurrently to the upper end portion of the filled bag and (iv) direct the clipper gates to open to release the clipped bag.

Some embodiments are directed to computer program products for operating a system for producing shot bags. The computer program products include a non-transitory computer readable storage medium having computer readable program code embodied in the medium. The computer-readable program code includes: (a) computer program code configured to deploy a clamp assembly with an open flow channel and a clamp in the packaging apparatus to clamp the loaded bag in position; (b) computer program code configured to direct explosive material to flow into the loaded shot bag through the flow channel to fill the bag to a desired level; (c) computer program code configured to close clipper gates of a clipper residing under the clamp to close against an upper end portion of the respective shot bag; (d) computer program code configured to direct the bag clamp assembly to pull a neck portion of the bag above the clamp upward using the clamp assembly while the clipper gates are closed against a portion of the bag thereunder before automatically clipping; and (e) computer program code configured to direct the clipper to apply at least one clip to the upper end portion of the filled bag while the clipper gates are closed and the bag has been pulled.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Although described above with respect to method aspects of embodiments of the present invention, it will be understood that these features may also be embodied as systems, subsystems, modules and/or computer program products.

These and other objects and/or aspects of the present invention are explained in detail in the specification set forth below.

BRIEF DESCRIPTION OF THE DRAWINGS

FIG. 11 is a chart of exemplary bag parameters that can be produced with packaging apparatus according to embodiments of the present invention.

DETAILED DESCRIPTION OF EMBODIMENTS OF THE INVENTION

Figure 1B:
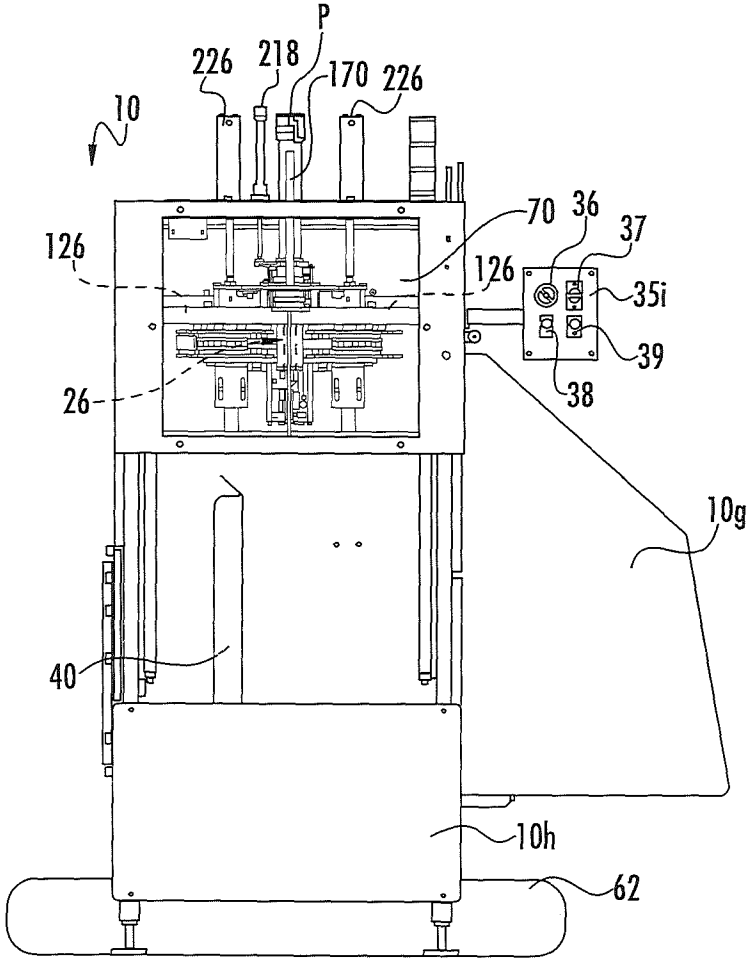
FIG. 1B is another front view of the apparatus shown in FIG. 1A with a front shield deployed down during filling according to embodiments of the present invention.
Figure 1A:
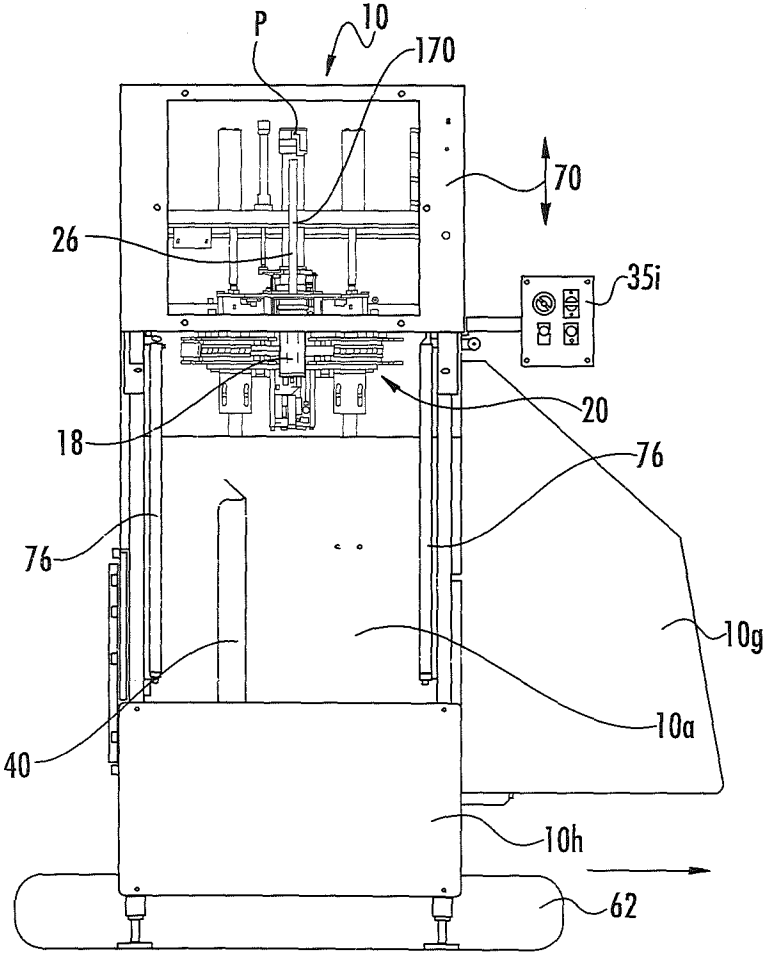
FIG. 1A is a front view of a packaging apparatus according to embodiments of the present invention.
Figure 1D:
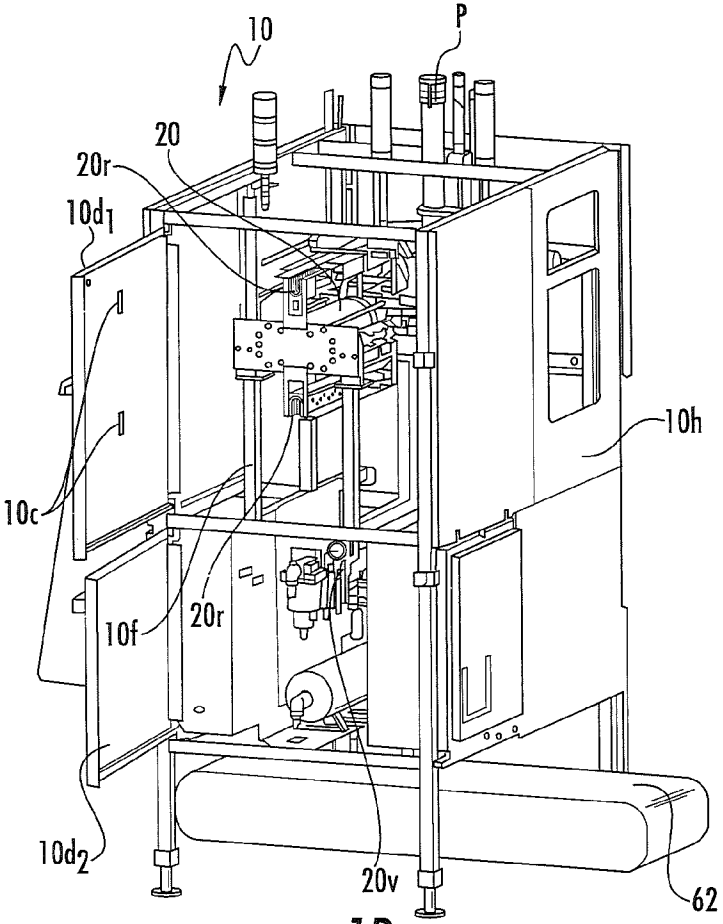
FIG. 1D is a rear perspective view of the apparatus shown in FIG. 1A with sidewalls omitted to show interior components according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. Features described with respect to one embodiment may be used alone or with another embodiment although not specifically described with respect to that other embodiment.

In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

The term "frame" means a generally skeletal structure used to support one or more assemblies, modules and/or components. The frame can be a floor mount and/or supported frame. The term "automated" means that operations can be carried out substantially without manual assistance, typically using programmatically directed control systems and electrical and/or mechanical devices. The term semi-automatic means that operator input or assistance may be used but that most operations are carried out automatically using electromechanical devices and programmatically directed control systems.

In the description of embodiments of the present invention that follows, certain terms are employed to refer to the positional relationship of certain structures relative to other structures. As used herein, the term "front" or "forward" and derivatives thereof refer to the general or primary direction that the flowed product travels in a production line to form an encased product; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the directions opposite, respectively, the forward and downstream directions.

The terms "filled" and "fill" and derivatives thereof mean to fill a bag with a desired amount of target product or material but does not require the bag or portion thereof to be full (e.g., at volumetric capacity).

The term "sleeve" refers to an enclosed tube or chute with open ends that directs flowable material into a target discharge container, typically a bag, for packaging.

The term "about" means the stated amount can vary by +/−20%.

Embodiments of the present invention are particularly suitable for packaging shot bags of explosives or blasting material using clippers to apply clips to at least one end of a filled shot bag. However, while particularly suitable for packaging explosives in shot bags, the machines may be used to package other products such as, but not limited to, processed meat products including whole or partial meat mixtures, including sausages and the like. Other embodiments of the present invention may be directed to seal other types of food or other product in casing or covering materials. Examples of other products include powders such as granular materials including grain, sugar, sand and the like or other flowable materials including wet pet food (similar to that held conventionally in cans) or other wet or dry material including powder, granular, solid, semi-solid or gelatinous materials, e.g., emulsions, gravel, soil, fertilizers or even liquids.

The machines can package products for any suitable industry including food, aquaculture, agriculture, environmental, chemical, explosives or other applications.

Conventional shot bag designs can include a polymeric (e.g., polyethylene) liner that is integrated inside, sewn or otherwise secured, a woven outer layer of fabric (e.g., polypropylene fabric). Explosives manufacturers can package their blasting agents in preparation for transport to a target job site in the shot bags. Thus, typically, these shot bags are designed to be filled with product, closed upon filling with one or more clips, typically metallic clips, then transported by bulk, such as in a truck, railroad or ocean container and transported to a blast site.

The filled shot bags can be used in holes, typically ranging from 10 feet to 70 feet in depth that may have accumulated water or for any other suitable uses. The purpose of the conventional two-ply shot bag is to contain the blasting agent during transport and keep the blasting agent waterproof upon dropping the product in the hole. However, for single ply, woven-only bags, these bags may be loaded onsite directly from a bulk source of explosives and substantially immediately placed into the hole.

Embodiments of the invention may be used to package single or multiple layer bags, such as shot bags, ranging in size from between about 1-24 inches in diameter, typically between about 2-10 inches in diameter, and in some embodiments between about 3-8 inches in diameter. The filled bags can have any suitable length, typically between about 10 inches to about 100 inches long and more typically between about 30-80 inches long, such as about 50 inches long.

The term "bag" refers to a flexible (non-rigid) container having one or two open ends. Where there are two open ends, one end is typically closed prior to use in the packaging devices described herein. However, it is contemplated that the bags can be formed in situ onboard the packaging device itself by closing one end before filling such as by using clips applied by the onboard clipper or a pre-staging clipper assembly. Typically, the bags are pre-formed as respective bags with a single open end. The bags can comprise one material layer, laminated layers of the same or different materials or two or more overlying layers of the same or different materials. The bags can comprise any suitable material for a particular application including, but not limited to, polymers or mylar films in shirred casings, heavy-duty woven polypropylene and polyethylene shot-bags, multi-wall laminates and the like. The bags can include an inner liner, an outer liner and outer film. The liners can have lengths between 30-60 inches, typically between about 40-51 inches, in some embodiments, to provide filled bags in lengths of between 20-40 inches.

The terms "explosives" and "blasting materials" refer to any suitable material used for such purposes including, but not limited to, UN 1.1D and UN 1.5D water-based emulsion, water-gel and (commercial grade) slurry explosives.

Turning to FIGS. 1A-1D, an exemplary packaging apparatus 10 is shown. As shown, the apparatus 10 includes at least one clipper 20 and a bag clamp assembly 26 as will be discussed further below.

To be clear, although shown as configured to fill a single bag at one time, the packaging apparatus 10 can be configured to hold a plurality of closely spaced apart bag filling stations that have shared or dedicated cooperating clippers 20.

As shown, the apparatus 10 includes a sleeve 18 that is attached to a pipe P (FIGS. 2A-2C) that is typically attached to a flexible hose or tube 118 that is in fluid communication with a supply of product (e.g., explosives or blasting material or other flowable product). The sleeve 18 can be semi-rigid, rigid or flexible, typically with more rigidity than the flexible hose upstream thereof. The product can be pumped through a conduit or manifold system to the pipe P held inside (or outside) the sleeve 18.

Figure 3C:
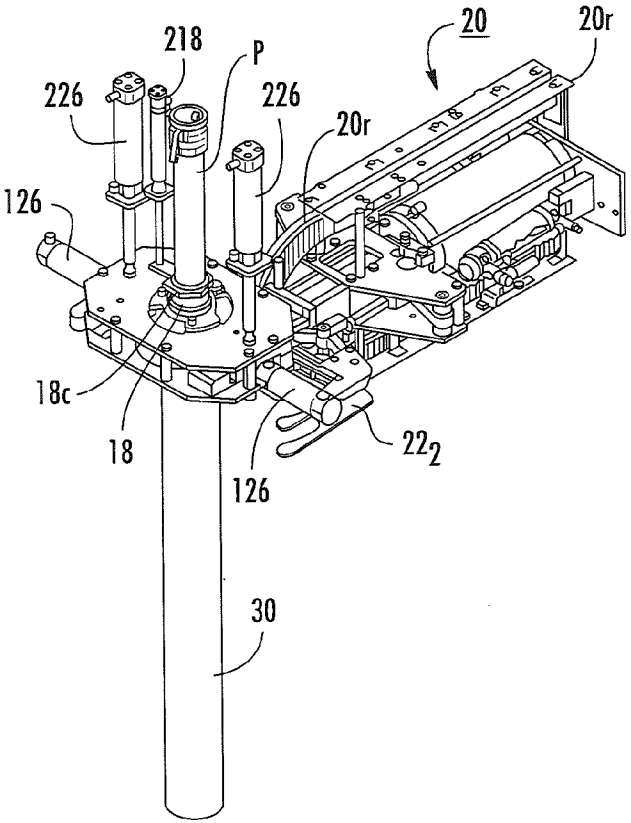
FIG. 3C is a side perspective view of the device shown in FIG. 3B.
Figure 3B:
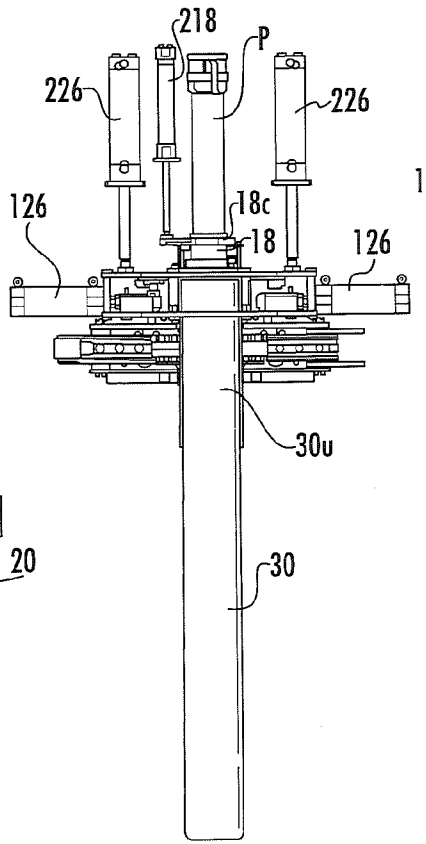
FIG. 3B is a front view of the components shown in FIG. 3B illustrating an exemplary bag positioned on the device according to embodiments of the present invention.
Figure 3A:
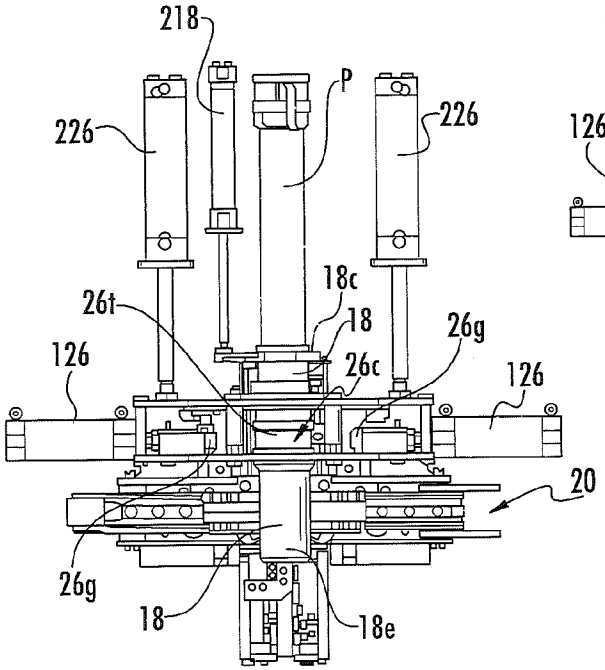
FIG. 3A is a partial front view of cooperating components suitable for use in a packaging apparatus, including a clipper and bag clamp assembly, during a bag "loading" operation such as shown in FIG. 2A, according to embodiments of the present invention.

The sleeve 18 can optionally include an air passage 19 (FIGS. 4A, 4B) that extends along at least one location that allows air or other gas to be introduced into the bag 30 when the passage 19 is below the clipper gates 22 (and, where used, below the clamp assembly tube 26*t*, FIG. 13B) as shown in FIG. 3A. This port or air passage 19 can allow a burst of pressurized gas or air to be blown into the bag 30 once it is loaded to help open, extend or remove creases from the bag, typically prior to filling. Any suitable pressure can be used, such as between about 30-120 psig, typically line pressure of about 80 psig.

The apparatus 10 includes a housing 10*h* with a support frame 10*f*. The housing 10*h* can include a front guard 70 that can translate up and down. The translation can be manual and/or under electronic control, and is typically automatic under machine control, once a bag 30 (FIG. 2A) is in position. The front guard 70 can be configured to travel up to expose a bag clamp assembly 26 and the lower end of the sleeve 18 to allow an operator or robot to load a bag, then translate down as shown in FIG. 1B to cover the clipper 20 during operation (typically prior to filling and clipping). The travel can be between about 5-30 inches, typically about 15 inches. The travel can be automatically carried out using an actuator such as a pneumatic cylinder 170 shown in FIGS. 1A and 1B.

As shown, the apparatus 10 can also optionally include an open region 10*a* under the guard 70 which may have optical sensors such as light curtains 76 to detect for disturbance during operation for protection/safety. Alternately, windows, doors or other configurations may be used.

The housing 10*h* can partially enclose a conveyor 62 and may include a guard 10*g* that extends out from the housing 10*h* over a portion of the conveyor 62 and angles down to stop a distance above the conveyor 62, typically a distance between 10-20 inches, such as about 15 inches, about 16 inches, about 17 inches, about 18 or and about 19 inches. The housing 10*h* can have a relatively compact footprint. For example, a first width W1 may be between 20 inches to about 60 inches, typically about 55 inches in the front and back. The apparatus 10 can have a side width W2 that is between about 40-80 inches, typically about 55 inches (excluding the conveyor and housing guard 10*g*) and about 67 inches with the housing guard 10*g*. The housing 25*h* can have a height H that is about 94 inches tall (not including the flex hose 118*f*).

Figure 1C:
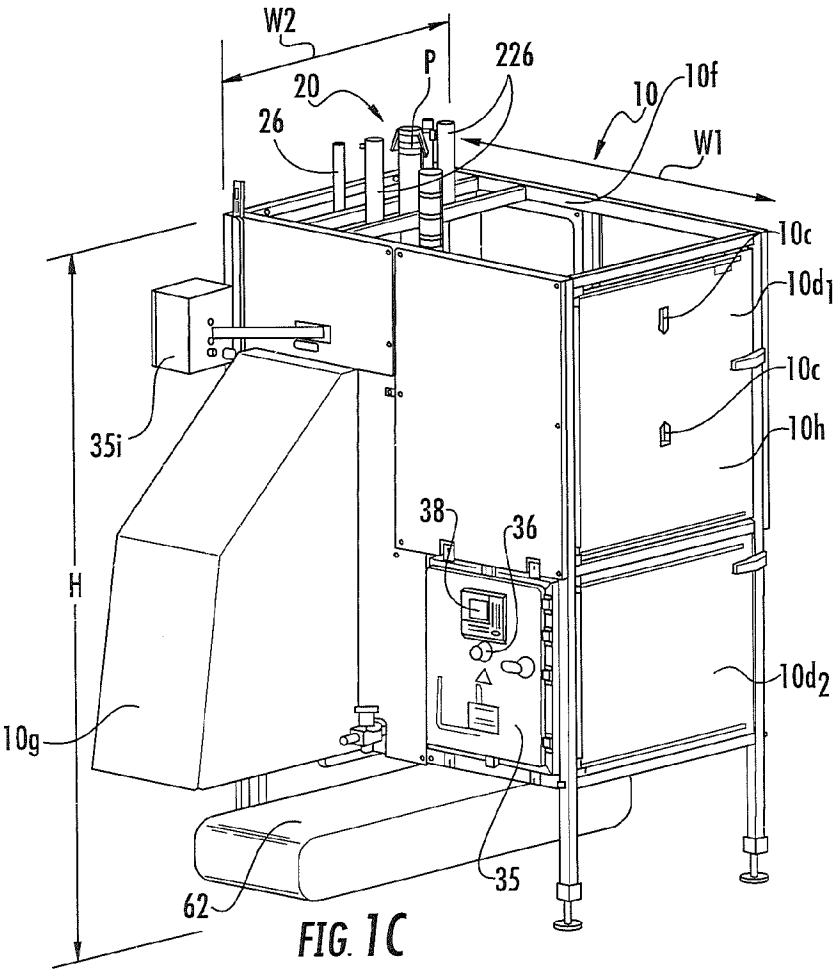
FIG. 1C is a rear, side perspective view of the apparatus shown in FIG. 1A.

The apparatus 10 can also include a lower bag support member 40 that resides under the clipper 20 and supports a lower portion of a respective bag 30 during filling, an operator interface 35*i* and electrical control box 35 (FIG. 1C). The operator interface 35*i* can include an Emergency stop 36, cycle start/stop 37, reset 38 and manual clip 39 (the latter simulates a pump or fill "complete" signal). The electrical box 35 can include a second Emergency stop 36 and HMI (Human Machine Interface) screen 38 to display diagnostic information.

Other lower support member configurations can be used and other filled/clipped bag transport systems may be used.

The outer sidewalls of the housing 10*h* can surround long sides of the conveyor 62 therein and can enclose the lower support member 40. An outlet over the conveyor 62 can be provided on one side of the housing 10*h* via guard 10*g* which is in line with the conveyor and typically 90 degrees to the plane of the shield 80.

In some embodiments, the apparatus 10 can include upper and lower rear doors 10$d_1$, 10$d_2$ that open to allow access to interior components. The upper door 10$d_1$ can open to allow access to the clipper 20 and can include cutouts 10*c* that are in line with the clip rails 20*r*. The lower door 10$d_2$ can allow access to the FRL (filter, regulator, lubricator) and other pneumatic components.

Figure 4B:
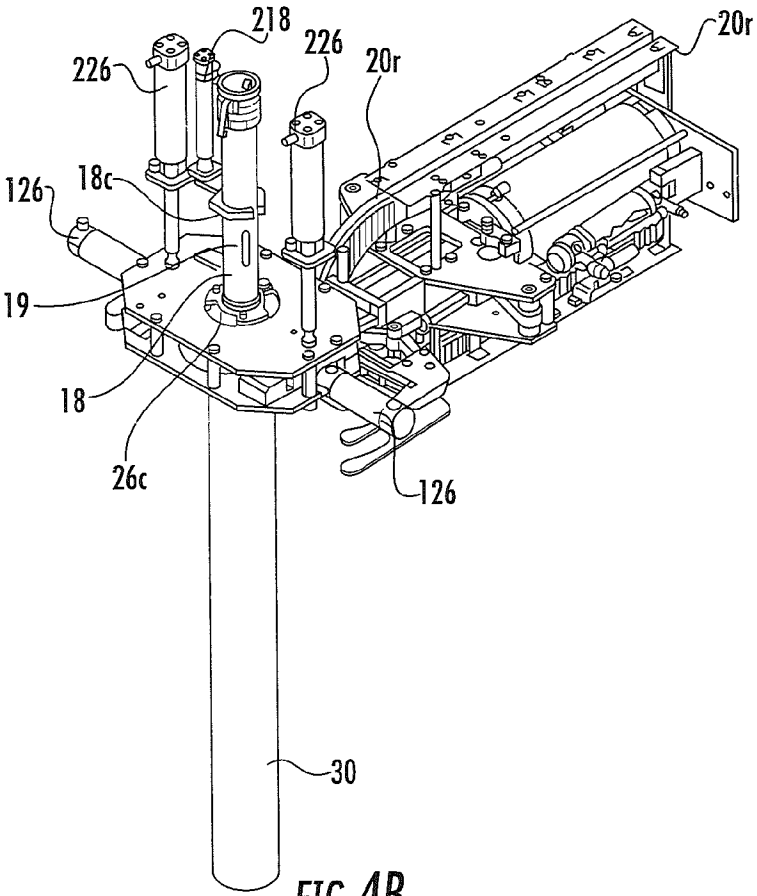
FIG. 4B is a side perspective view of the components shown in FIG. 4A.
Figure 4A:
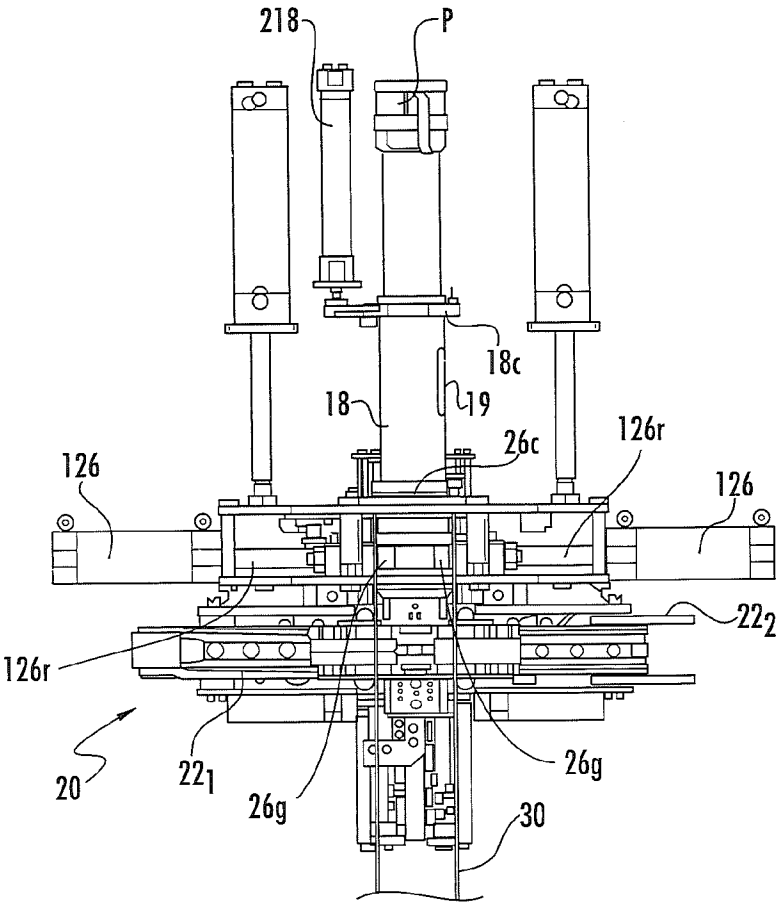
FIG. 4A is a front view of the components shown in FIG. 3A illustrating exemplary positions of the cooperating components during a filling operation according to embodiments of the present invention.

Referring to FIG. 1B, the apparatus 10 includes a plurality of lift actuators 218, 226 that can extend and retract vertically. In the embodiment shown, the actuators are pneumatic, but other actuators can be used including, hydraulic and electric. As shown, the actuators can include a sleeve lift cylinder 218 that can raise and lower the sleeve 18 a defined distance so that the lower end of the sleeve 18*e* is below the clipper 20 during loading for ease of operator access as shown in FIGS. 2A and 3A-3C, for example, and above the clipper 20 during filling as shown in FIGS. 2B, 4A and 4B.

In some embodiments, the clipper 20 can be configured to also or alternatively translate for ease in bag loading instead of or with the sleeve 18. In yet other embodiments, both the sleeve 18 and clipper 20 may remain in a static position without requiring a load configuration. A tool can be used to thread the upper end of the bag onto the sleeve 18 while the clipper 20 is in position.

Figures 2A, 2B, 2C:
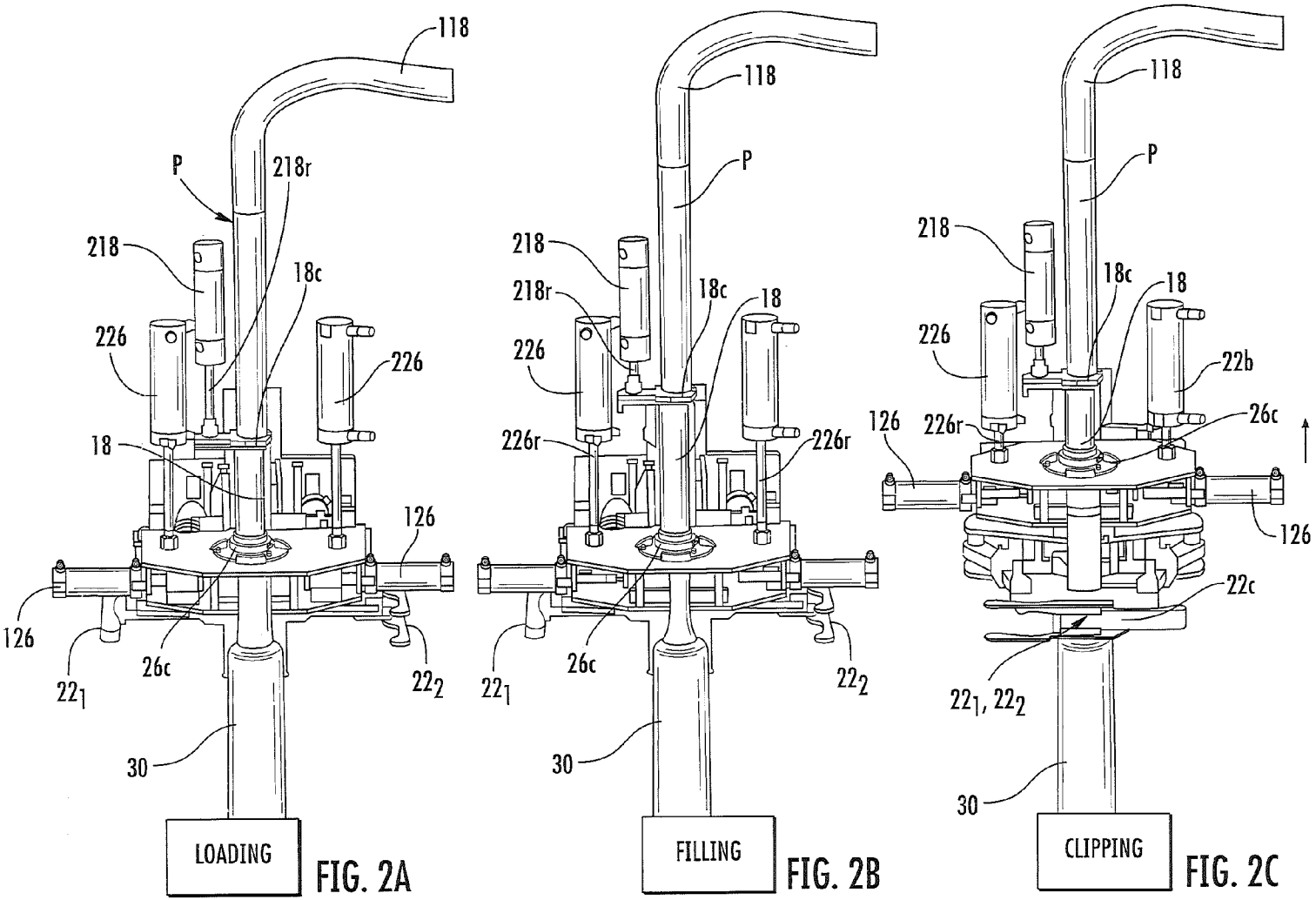
FIGS. 2A-2C are partial sequential views of components of the packaging apparatus, such as that shown in FIG. 1A, for example, illustrating respective "loading", "filling" and "clipping" positions/configurations according to embodiments of the present invention.
Figure 5B:
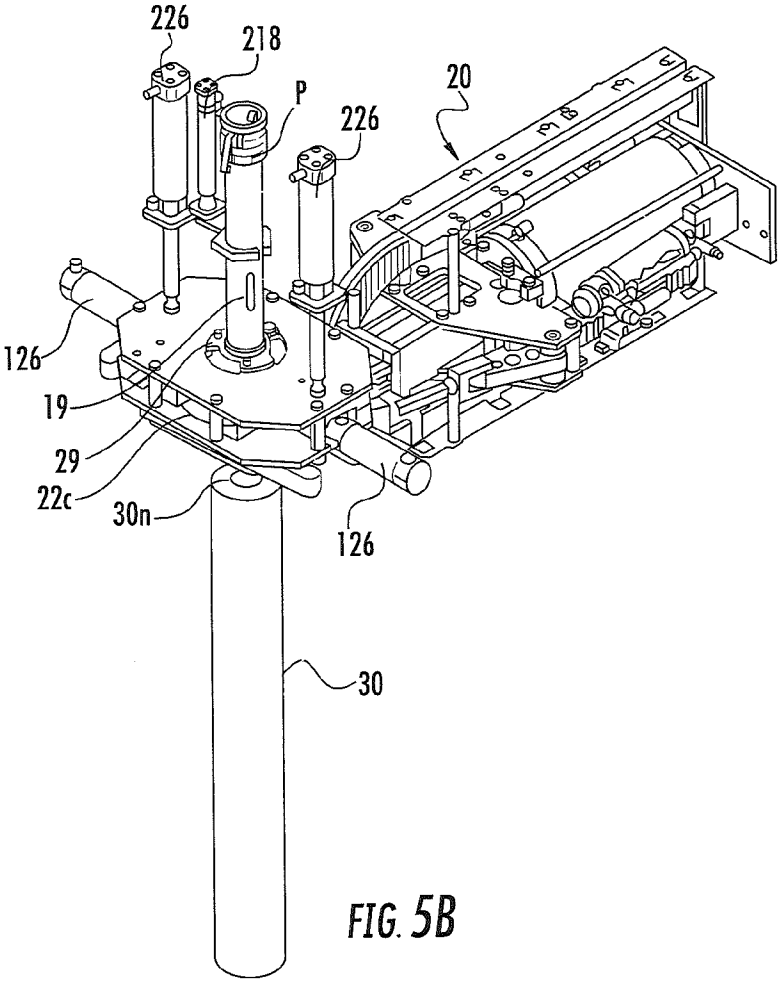
FIG. 5B is a side perspective view of the components shown in FIG. 5A.
Figure 5A:
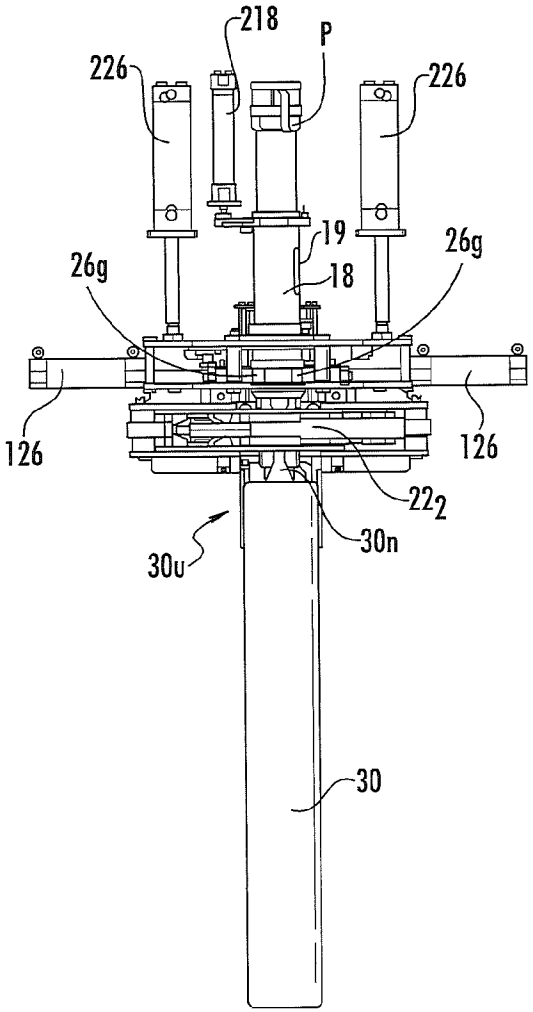
FIG. 5A is a front view of the components shown in FIG. 3A illustrating exemplary positions of the cooperating components after a filling operation according to embodiments of the present invention.
Figure 13B:
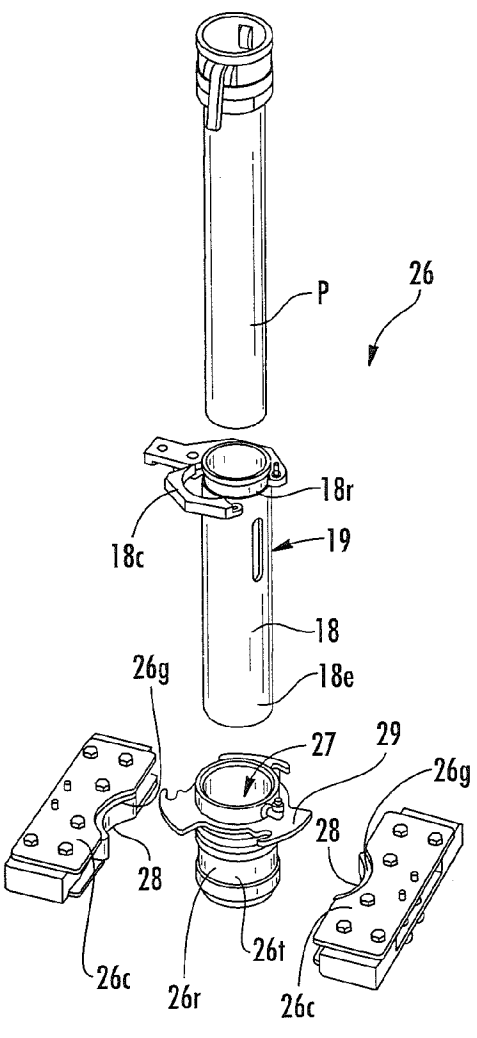
FIG. 13B is an exploded view of some components of the bag clamp assembly, pipe and sleeve shown in FIG. 13A.
Figure 13A:
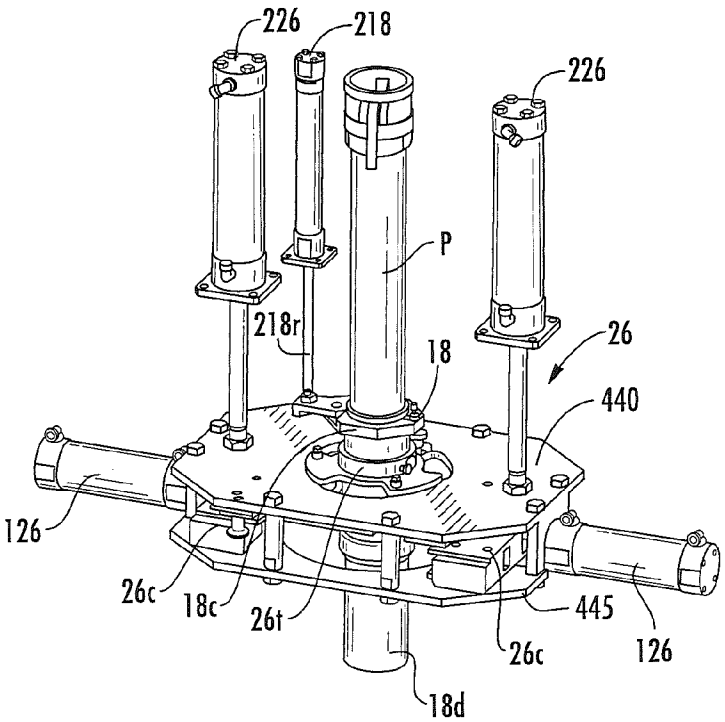
FIG. 13A is a front perspective view of a bag clamp assembly with a sleeve and pipe according to embodiments of the present invention.
Figure 13C:
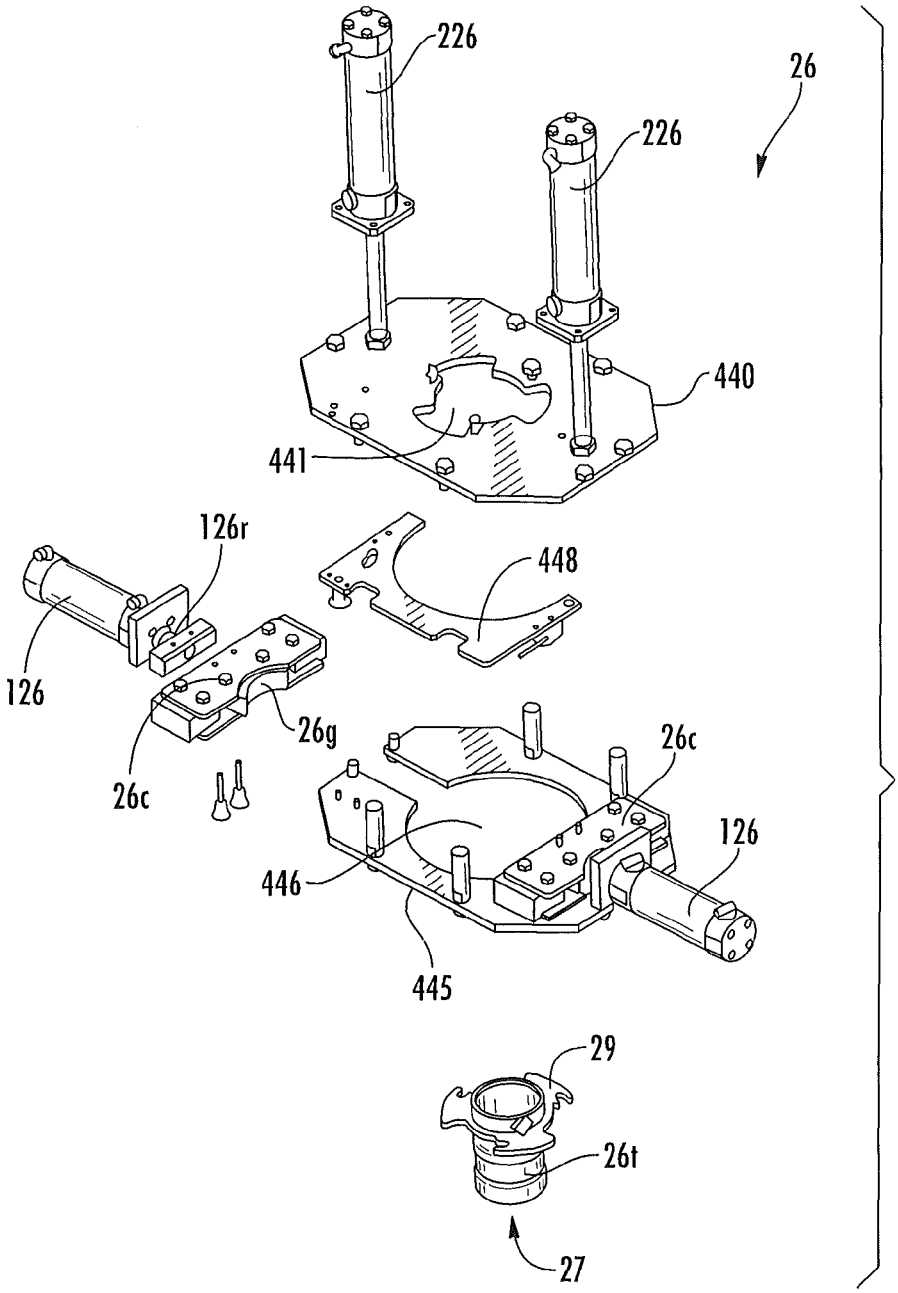
FIG. 13C is an exploded view of the bag claim assembly shown in FIG. 13A.

The apparatus 10 can also include at least one clamp lift cylinder 226, shown as comprising two spaced apart cylinders 226 that cooperate to pull the upper end of the bag 30*u* upward after the clipper gates 22$_1$, 22$_2$ are closed to form a tight neck 30*n* as shown in FIGS. 2C, 5A and 5B, for example. The apparatus 10 can also include at least one laterally extending clamp actuator 126 that can include a rod 126*r* (FIG. 4A) that can extend and retract laterally to tighten and loosen at least one bag clamp 26*c* that holds the upper portion of the bag 30*u* against tooling that can reside inside the bag such as a short tube or collar 26*t* (FIGS. 13A-13C).

The sleeve 18 is sized and configured to slidably receive a portion of a length of pipe P. The pipe P can move up and down during filling, but typically has a substantially fixed position during loading and/or filling. The sleeve 18 may translate up and down a distance relative to the pipe P during loading and filling. The pipe P can reside above the clipper gates 22 at all times while the sleeve 18 can travel down below the clipper gates 22 during a bag loading operation.

The sleeve 18 can be configured to enclose a lower end portion of the pipe P at a loading position (FIGS. 3A-3C) and slidably receive more of the pipe P, such as about 40%-80% or more of a length of the pipe P, during a filling and clipping operation (FIGS. 4A, 4B, 5A, 5B, 6A, 7A). Both the sleeve 18 and the pipe P reside above the clipper gates 22 before the gates are closed to allow the gates 22 to close tightly against only the neck or upper portion of the bag 30*n*.

The sleeve 18 is shown as residing outside the pipe wall, but can alternatively slidably receive the pipe P but reside inside the pipe wall.

In other embodiments, the pipe P can be held directly inside a center channel of the clamp assembly 26 without requiring a translating sleeve 18.

The pipe P can be attached to a flex hose 118 upstream of the collar 18*c*. The flex hose 118 can be attached to a flow pipe that delivers the target product, e.g., explosive or blasting material from a bulk supply source. The pipe P can be used without the sleeve and/or the flex hose can be used without a pipe P or sleeve 18 in some embodiments. Each can be supplied by a factory or used with components onsite or may be onboard the apparatus.

The clipper 20 can be an automated or semi-automated clipper 20 that applies at least one clip to the upper end portion 30*u* of the bag 30 after filling. The clipper 20 can be configured to apply clips substantially horizontally (side-to-side, back-to-front, or front-to-back) rather than from top-to-bottom or bottom-to-top, while the filled bag is held substantially vertically. However, other orientations of the bag 30 and/or clipper 20 may be used.

FIGS. 2A-2C illustrate a sequence of operations corresponding to loading, filling and clipping according to some embodiments of the present invention. During loading, the sleeve 18 can be lowered to a position that places the lower end of the sleeve below the clipper 20 as shown in FIG. 2A. Once a bag is positioned properly as detected by a sensor or by manual indication, the bag clamp assembly 26 can translate to hold the bag 30 in position, typically against tooling such as a short tube 26*t*. A blast of pressurized gas, typically air, can be blown into the bag 30 via vent or air passage 19 to cause the bag 30 to open substantially fully prior to flowing the target product into the bag 30. The sleeve 18 can rise prior to or during filling to move out of the way of the clipper gates $\mathbf{22}_1$, $\mathbf{22}_2$ as shown in FIG. 2B and/or to keep product out of the air passage 19 used to deliver a pressurized blast of gas (where such is used). The sleeve 18 may move reciprocally between about 2-12 inches, typically between about 4-8 inches, such as about 6 inches, between loading and filling/clipping positions.

An operator can slide a respective (empty) bag 30 up at least a major portion of a length of the sleeve 18, e.g., between 50-90% up over its length and the bag 30 can be free to slide down its outer wall during filling, below its clamped zone, as the product accumulates in the bag.

As shown in FIG. 2B and FIGS. 4A and 4B, the lift cylinder 218 can be attached to a collar 18*c* that resides about an upper end portion of the sleeve 18. Compare the position in FIG. 2A with that in FIG. 4A which illustrates the low and raised levels, respectively. As shown, the actuation rod 218*r* is retracted in FIG. 2B relative to the extended position in FIG. 2A.

Figure 6B:
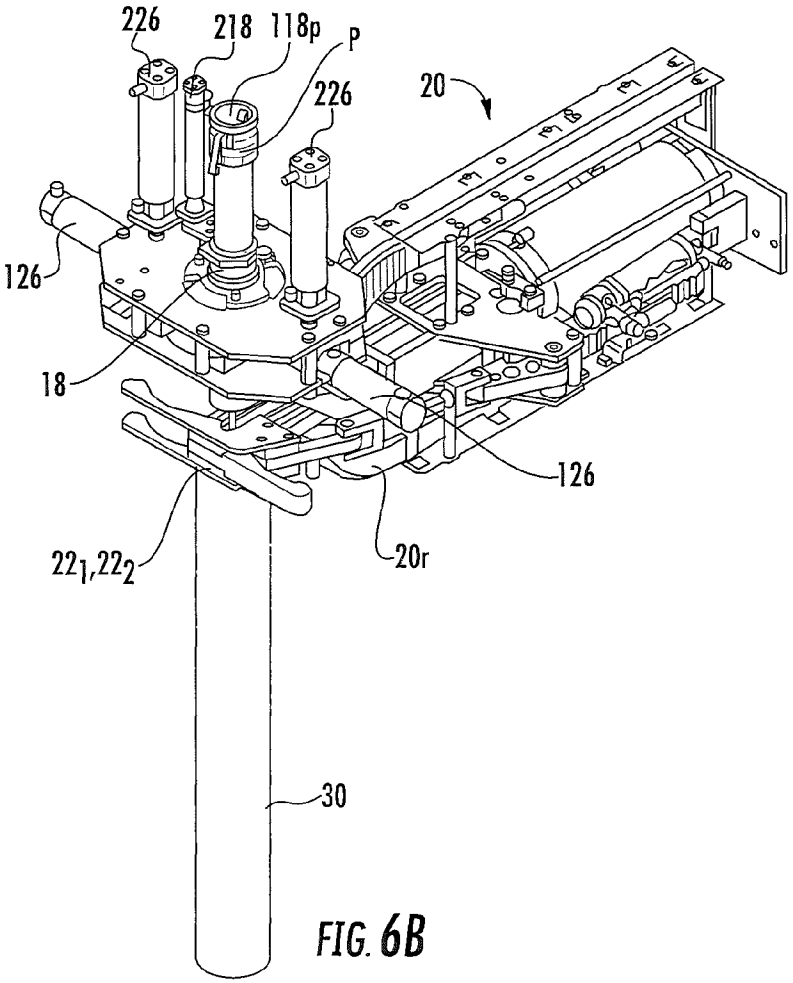
FIG. 6B is a side perspective view of the components shown in FIG. 6A.
Figure 6A:
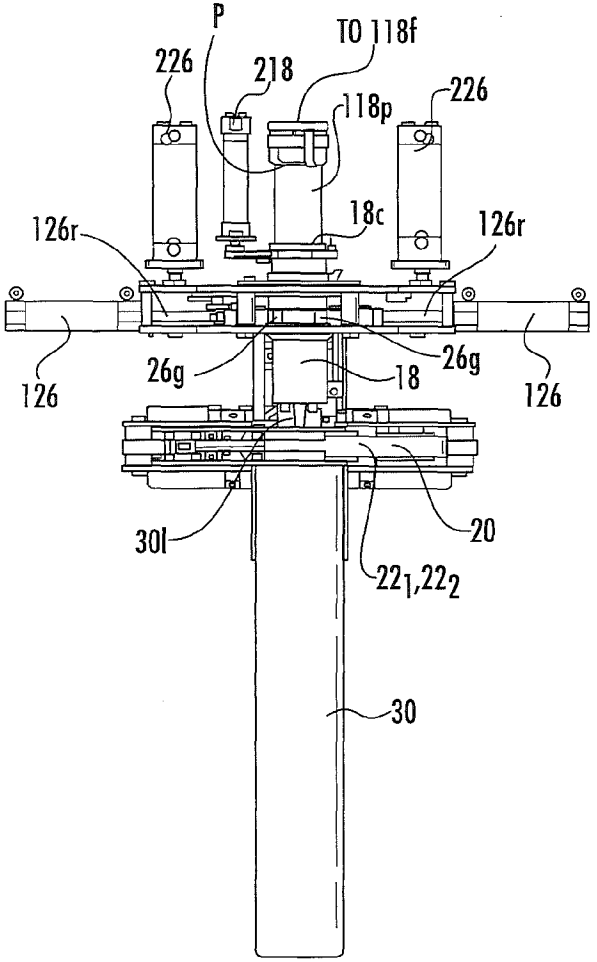
FIG. 6A is a front view of the components shown in FIG. 3A, illustrating exemplary positions of the cooperating components post-fill according to embodiments of the present invention.

After filling, the clipper gates $\mathbf{22}_1$, $\mathbf{22}_2$ close together (shown at 22*c*) as shown in FIG. 2C, and the clamp lift cylinders 226 retract rods 226*r* that lift an upper end of the bag while the gates 22 restrict movement of the lower portion of the bag thereunder to create a tight neck or rope 30*n* as shown in FIGS. 5A and 5C. The clamp lift cylinders 226 raise the clamp assembly 26 sufficiently to pull the bag tight against the bottom of the clipper gates $\mathbf{22}_1$, $\mathbf{22}_2$; when closed as shown in FIGS. 6A and 6B; the apparatus 10 can then apply at least one clip (typically at least two clips) using the clipper 20.

While or before filling a respective bag 30 with target flowable (pumped) product or at least prior to closing the clipper gates or applying a clip or clips to the bag, the front guard 70 can slide down or lower into the clip protection position (FIG. 1B) to limit access to the clipper 20. The light curtain 76 can monitor the front opening 10*a*. Once the safety circuit indicates the apparatus 10 is in a safe configuration, a safety valve 20*v* (FIG. 1D) supplying air to the clipper 20 can energize. If the safety circuit detects a fault or is broken after this point, the system 10 can "fault" and dump the air, disallowing clipper operation. Once the filling is complete, the clipper gates close 22*c* to form a tight rope as shown in FIGS. 5A and 5B. The apparatus 10 can be configured to monitor a fill complete signal from an on-board sensor and/or from a pump system in communication with the sleeve 18 to automatically close the gates $\mathbf{22}_1$, $\mathbf{22}_2$ and operate the clipper 20 for efficient operation.

Figures 7A, 7B, 7C:
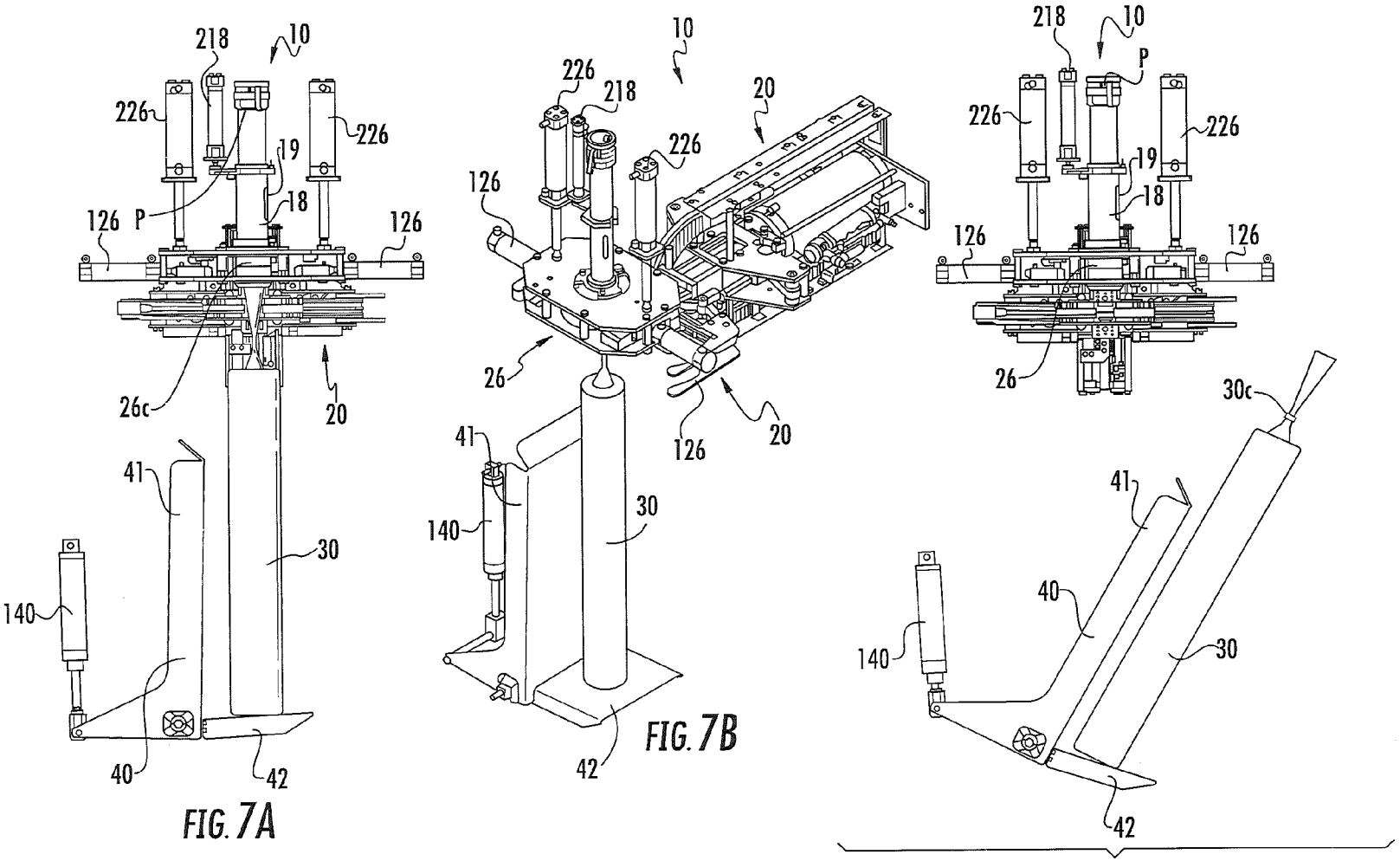
FIG. 7A is a front view of the components shown in FIG. 6A, aligned with a lower product support according to embodiments of the present invention.
FIG. 7B is a side perspective view of the components shown in FIG. 7A illustrating the clipper gates open to release a filled, clipped bag according to embodiments of the present invention.
FIG. 7C is a front perspective view of the components shown in FIGS. 7A and 7B, with the clipper gates and clamps open and the product support in a discharge orientation according to some embodiments of the present invention.

FIGS. 7A-7C illustrates an example of a sequence of operations using an exemplary lower product support member 40. In this embodiment, the member 40 resides under the bag 30 during filling and is in communication with an actuator 140 that is pivotably attached to a bottom portion of the member. The filled, clipped bag 30*c* is released by the clipper gates $\mathbf{22}_1$, $\mathbf{22}_2$ and the bag clamp assembly 26 whereupon it can be released and allowed to fall onto the tilt plate 42. The support member 40 can tilt to direct the filled bag down onto a collection member, such as, for example, an adjacent conveyor 62 (FIGS. 1A-1D). Other collection members may be used instead of or with the conveyor including bins, boxes, portable carts and the like.

Figure 8:
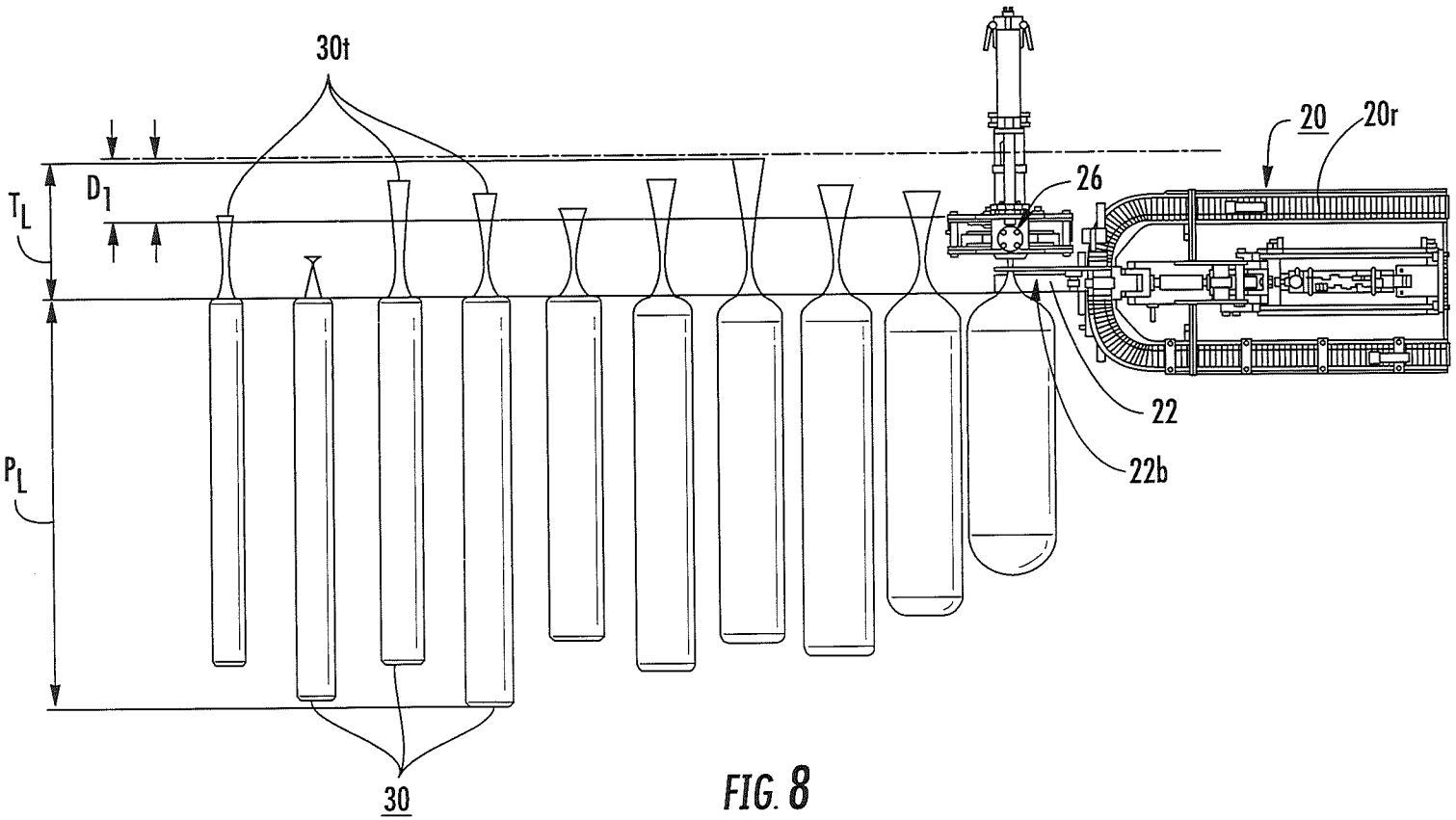
FIG. 8 is a schematic illustration of differently sized products that may be produced using the packaging apparatus according to embodiments of the present invention.

FIG. 8 illustrates that the apparatus 10 can be configured to accommodate different size products 30 with different diameters and lengths $P_L$. As shown, the different size products are shown pulled tight against a bottom 22*b* of the clipper gates 22. The tails 30*t* are shown in different lengths $T_L$, but can be standardized to a desired length range, e.g., between 3-15 inches. The tail lengths can be controlled using operation of the clamp assembly 26, positioning of a respective bag on the sleeve (sleeve position), travel distance and known bag characteristics, for example.

The clamps 26*c* of the bag clamp assembly 26 may have a maximum vertical travel distance of between about 2-12 inches, such as about 3 inches, about 4 inches, about 5 inches, about 6 inches, about 7 inches, about 8 inches, about 9 inches, about 10 inches, about 11 inches or about 12 inches. However, other travel distances may be used. The travel distances may also be adjusted by product or desired output. These inputs can be provided as a "recipe" allowing for recipe management of the lengths depending on predefined operational parameters that achieve the desired tail length via an HMI or programmed controller.

Figure 9B:
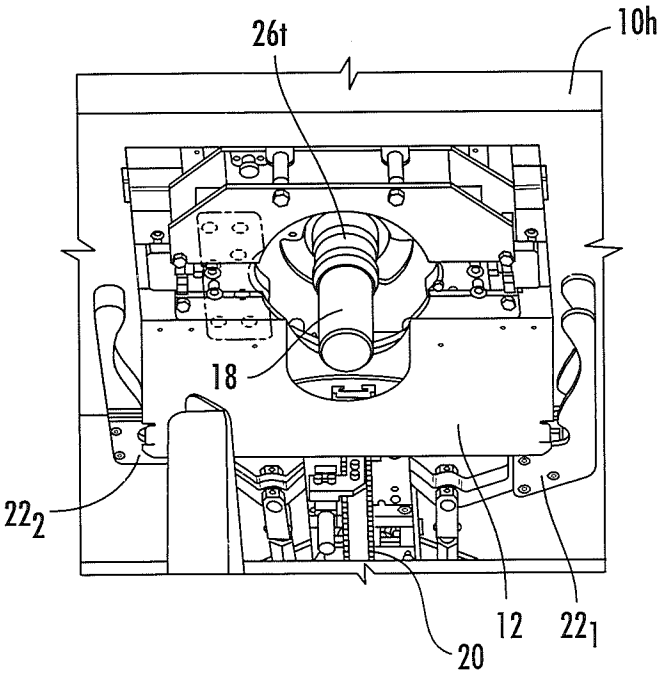
FIGS. 9A and 9B are partial perspective views of an interior space of the apparatus shown in FIG. 1A illustrating a hinged access door above the clipper which can allow user access for tooling change out.
Figure 9A:
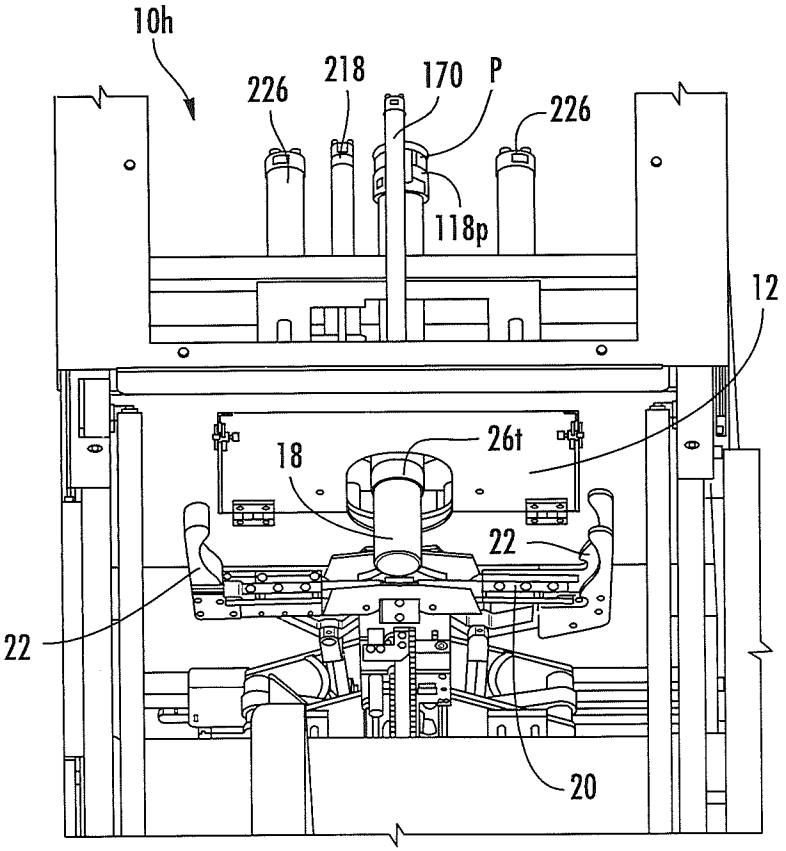

FIGS. 9A and 9B illustrate an upper portion of the housing 10*h*. The apparatus 10 can include a hinged door or wall 12 that pivots down as shown to allow an operator to change out tooling to use different size sleeves 18 and/or clamp components, for example. The door or wall 12 can also be slidably attached or otherwise releasably mounted to provide the desired access.

Figure 10:
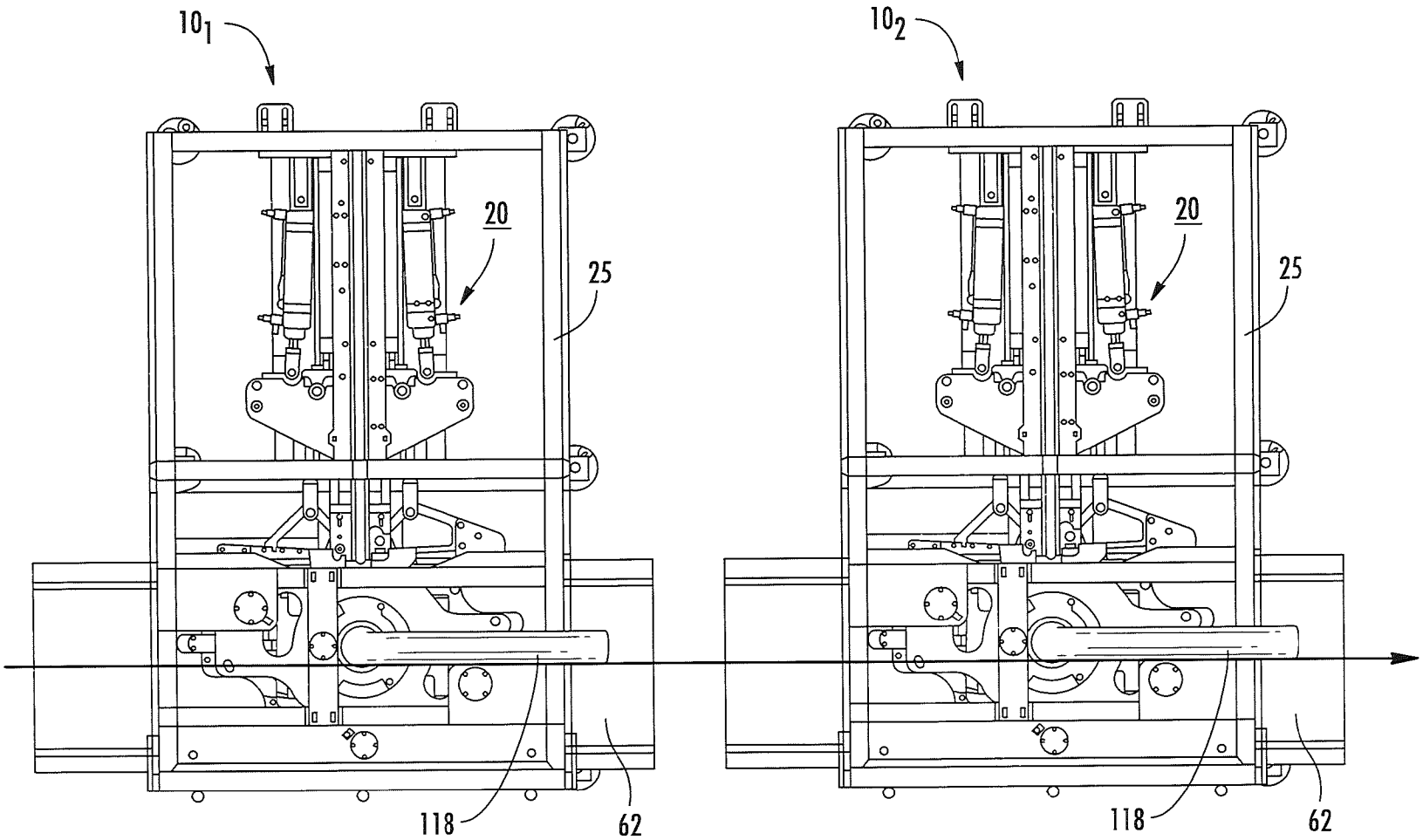
FIG. 10 is a schematic illustration of an example of an in-line conveyor set up for a factory layout of multiple packaging apparatus according to some embodiments of the present invention.

FIG. 10 illustrates an inline conveyor set-up of adjacent apparatus $\mathbf{10}_1$, $\mathbf{10}_2$ that may be used in some embodiments. Where in-line set-ups are used, the height of components of the second apparatus in line should be a sufficient distance above the conveyor of the first to allow the first apparatus's product to pass underneath. In some embodiments, the adjacent systems can be configured as a left and right hand machine so that two machines can be positioned side by side thereby allowing one operator to run the two machines.

In some embodiments, the apparatus 10 can interchangeably mount sleeves 18 and/or pipes P having different inner and outer diameters, typically between about 1.5 inches to about 3 inches (inner diameter) and thicknesses of between about ⅛ to about 0.5 inches. The different size sleeves 18 and/or pipes P can include a 1.5 inch inner diameter and a 2 inch inner diameter. The filled bags can be between 10-60 inches long, typically between 25-40 inches long. The larger diameter sleeves 18 and/or pipes P can be used to fill different diameter bags, typically between about 4-8 inch diameter bags while the smaller sleeve can be used to fill 3 and 3.5 inch diameter bags. The filled bags can weigh between 10-50 lbs, on average, such as, for example, about 10 pounds, about 15 pounds, about 20 pounds, about 25 pounds, about 30 pounds, about 40 pounds and about 50 pounds and any weight therebetween. In particular embodiments, the product can have a density of between about 1.21-1.28 g/cc. FIG. 11 is a table of exemplary bag and product properties.

Figure 12:
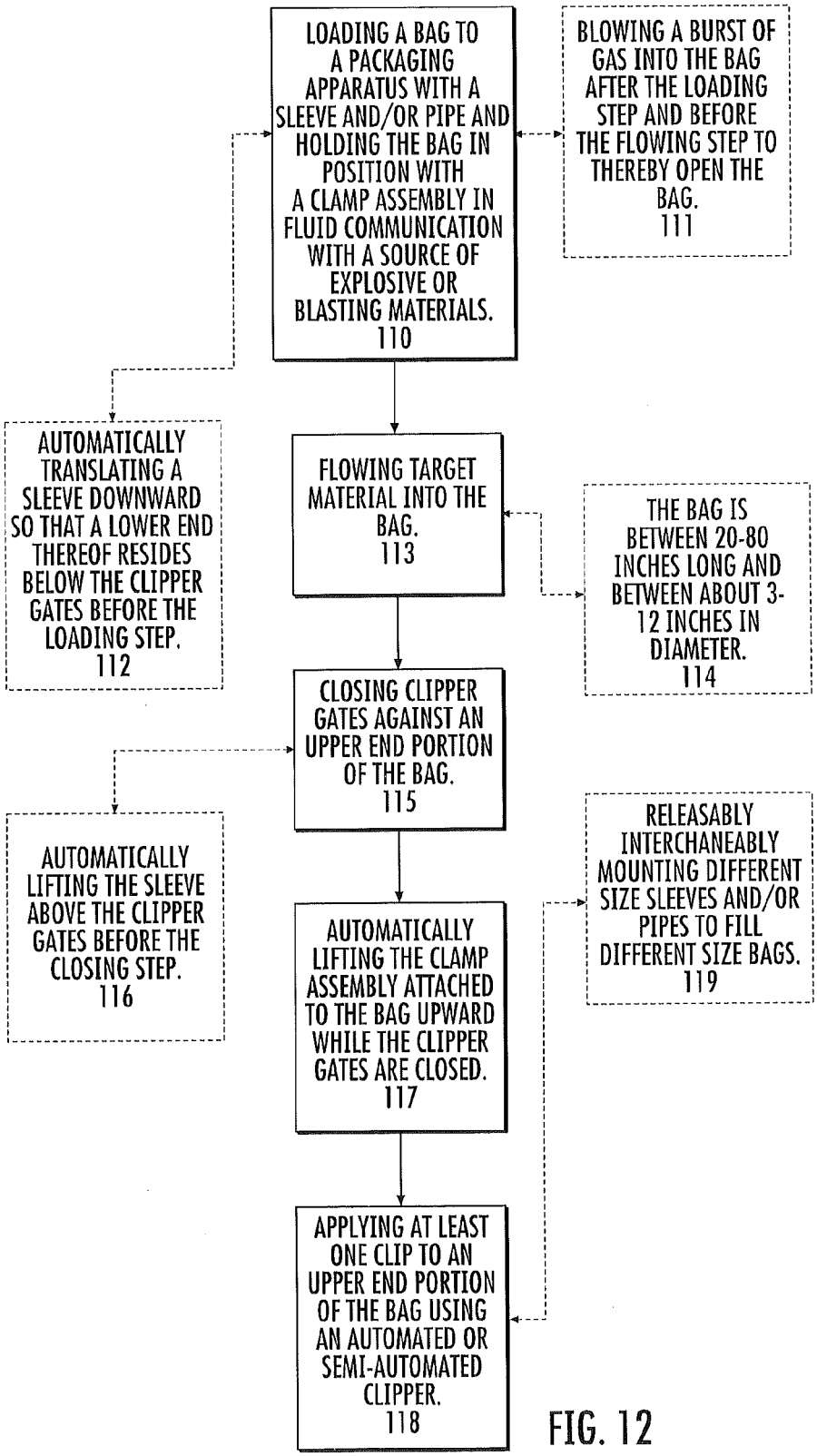
FIG. 12 is a flow chart of operations that can be used to carry out embodiments of the present invention.

FIG. 12 is a flow chart of exemplary operations that can be used to load, fill and clip a bag with target material, e.g., explosives, according to embodiments of the present invention. A bag is attached to the packaging apparatus with a clipper (manually or automatically) with a sleeve and/or pipe in fluid communication with a source of explosive or blasting materials, holding the bag in position using a clamp assembly (block 110). Source material is flowed into the bag, (block 113). Clipper gates are closed against an upper end portion of the bag. (block 115). A clamp assembly attached to the bag is automatically lifted upward while the clipper gates are closed thereunder. (block 117). At least one clip is then applied to an upper end portion of the bag using an automated or semi-automated clipper. (block 118).

Optionally, the method can include blowing a burst of gas into the bag after the attaching step and before the flowing step to thereby open the bag (block 111). The method can also include automatically translating a sleeve downward so that a lower end thereof resides below the clipper gates before the attaching step. (block 112). The bag can be between 20-80 inches long and between about 3-12 inches in diameter (block 114). The method may also include automatically lifting the sleeve above the clipper gates before the closing step (block 116). The method may also include releasably interchangeably mounting different size sleeves and/or pipes (and/or grippers of the clamps) to fill different size bags (block 119).

FIGS. 13A-13C illustrate an embodiment of the bag clamp assembly 26. As shown, the assembly 26 includes first and second cooperating grippers 26*g* that close against a tube 26*t* (which can also be described as a collar) to clamp against a bag 30 held therebetween. The tube 26*t* defines an open center channel 27 that is axially aligned (concentric) with sleeve 18 and/or pipe P through which the sleeve 18 and/or pipe P can extend. In some embodiments, the sleeve 18 can travel up and down through the channel 27 during operation. The tube 26*t* can be solid and contiguous over its outer wall or have apertures or channels over its perimeter. The tube 26*t* can be short, typically with a length that is less than the length of the sleeve 18, typically between about 1-10 inches long, more typically between about 1-8 inches long, such as about 1 inch, about 2 inches, about 3 inches, about 4 inches, about 5 inches, about 6 inches and the like.

As shown in FIG. 13A, the collar 18*c* can be attached to the rod 218*r* of the sleeve lift cylinder 218 to raise and lower the sleeve 18 during operation. The collar 18*c* can have arms that can attach to clamp against the outer wall of the sleeve 18. The sleeve 18 can include a recess 18*r* on an upper end portion thereof and the clamp can be configured to reside in the recess.

The bag support assembly 26 can include closely spaced apart upper and lower platforms 440, 445, that reside above and below, respectively the clamp actuators 126. As shown, the bag lift rods 226*r* are attached to the upper plate 440. As shown in FIG. 13C, an intermediate plate 448 can reside between the upper and lower plates 440, 445. The intermediate plate 448 can hold optical, magnetic or electrical sensors.

The bag support assembly 26 can include first and second grippers 26*g* with elastomeric gripper segments 28. In some embodiments, more than two cooperating grippers may be used. Such grippers can be vertically stacked and/or circumferentially spaced apart about the inner tool component, e.g., tube 26*t*. The tube 26*t* can receive the sleeve 18 and/or pipe P. The tube 26*t* can include a recess 26*r* that is sized and shaped to matably receive the grip segments 28. The upper end of the tube 26 can have circumferentially spaced apart wings 29 that fit in a correspondingly shaped aperture 441 in the upper platform 440 of the assembly 26. The lower plate 445 can also have a center aperture 446 but it need not have the same shape as the upper aperture 441 which holds the tube 26*t*.

In some embodiments, the bag clamp member(s) 26*c* resides on an outside of the bag 30 while at least a portion of the tube 26*t* extends down inside the bag 30.

In some embodiments, the bag clamp member(s) 26*c* can be reversed and configured to reside inside the bag 30 and press outward against an external collar or other cooperating external member. Other bag holding member configurations may be used including inner and outer clamps that cooperate to hold the bag 30 therebetween, while leaving a space for the sleeve 18 and/or pipe P to enter a distance into the bag 30. For example, other bag holding configurations can include hooks or prongs that extend outwardly or inwardly through the bag wall. The bags may optionally include pre-formed holes that cooperate with such features or the holes can be introduced at attachment.

The collar 18*c* and/or bag assembly 26 may also be adjustable in size or provided in different sizes to allow for packaging of different (cross-sectional, e.g., diameter) sized target products and/or for different size pipes P. In some embodiments, differently sized and/or configured support assemblies 40, collars 18*c*, clamps 26*c* (e.g., bag grippers 26*g*), tube 26*t* can all be changed with different sizes may be provided and the appropriate ones used to produce different size products.

The lift and clamp actuators can be attached to the bag clamp assembly as shown or one or more may be optionally mounted as separate components in the apparatus.

FIGS. 14A, 14B, 15A and 15B illustrate an alternate embodiment of the apparatus 10. In this embodiment, the device 10 can include a sleeve drive system 50 that includes a sleeve attachment member 28 that translates the sleeve 18 a desired distance up and down. The bag support member 26 can comprise a clamp 26*c* that can include a pair of clamp arms 26*a* that pivot open and close against an outer surface of the upper end portion of the bag 30*u* to hold and release a respective bag 30. However, as noted above other bag support members may be used.

As also shown, the lower support member 40 can comprise an open slot space 41 that can be configured to allow a filled bag to fall forward onto a support floor 60 that bridges to a conveyor 62, collection path, bin or other accumulation or collection container 61. The lower support member 40 can have an adjustable circumferential size and/or length and may be releasable attached to the support floor 60.

Referring again to FIGS. 14A, 14B, 15A and 15B, the drive system 50 can be closely spaced to the clipper 20 in cooperating alignment with the collar 18*c* and/or bag support assembly 26 to be able to direct the sleeve 18 to translate axially in line with a centerline of the bag when held in position for filling.

The sleeve translation distance can be at least a major portion of a target length of the filled bag, e.g., over 20 inches for a 40 inch bag, over 25 inches for a 50 inch filled bag. In some embodiments, the translation distance "L" can be between about 60-90% of the length of the bag 30 and/or sleeve 18. This distance can be predefined and/or selected as a user option and/or based on a "recipe" of the product being produced (identified programmatically by product type using a User Interface 35*i*, 39 (FIG. 1B) or the like. The sleeve drive system 50 can be configured to translate the sleeve attachment member 28, and hence sleeve 18, down to initiate or in response to the start of filling, then raise the sleeve 18 upward during filling at a desired rate or speed to reside proximate the collar 15 or bag support member 26 at an end of the filling operation.

Figure 14B:
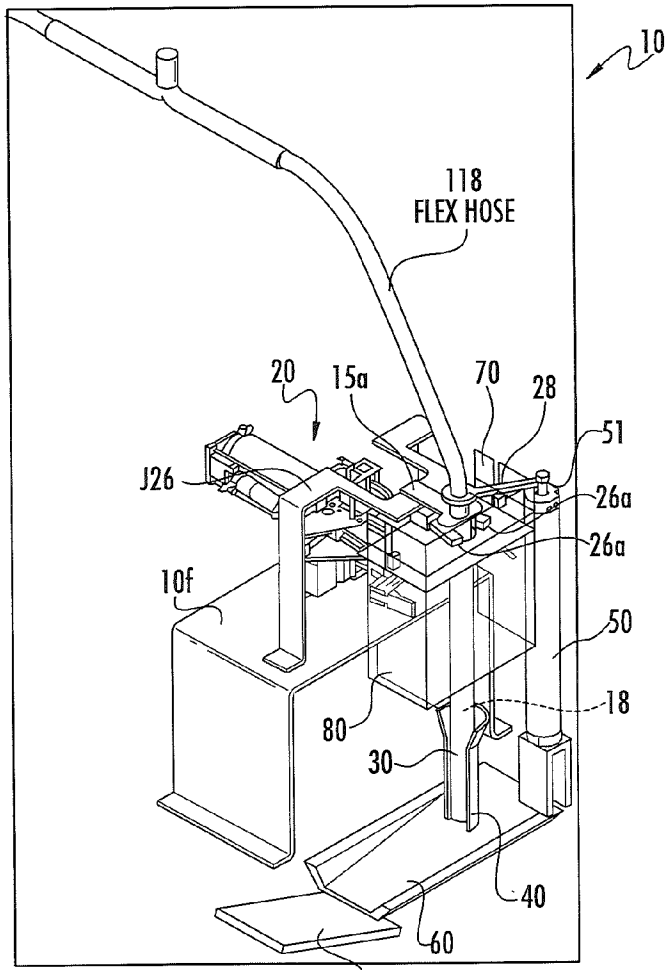
FIG. 14B is another side perspective view of the packaging apparatus shown in FIG. 14A illustrating a different position of moving members of the apparatus according to embodiments of the present invention.
Figure 14A:
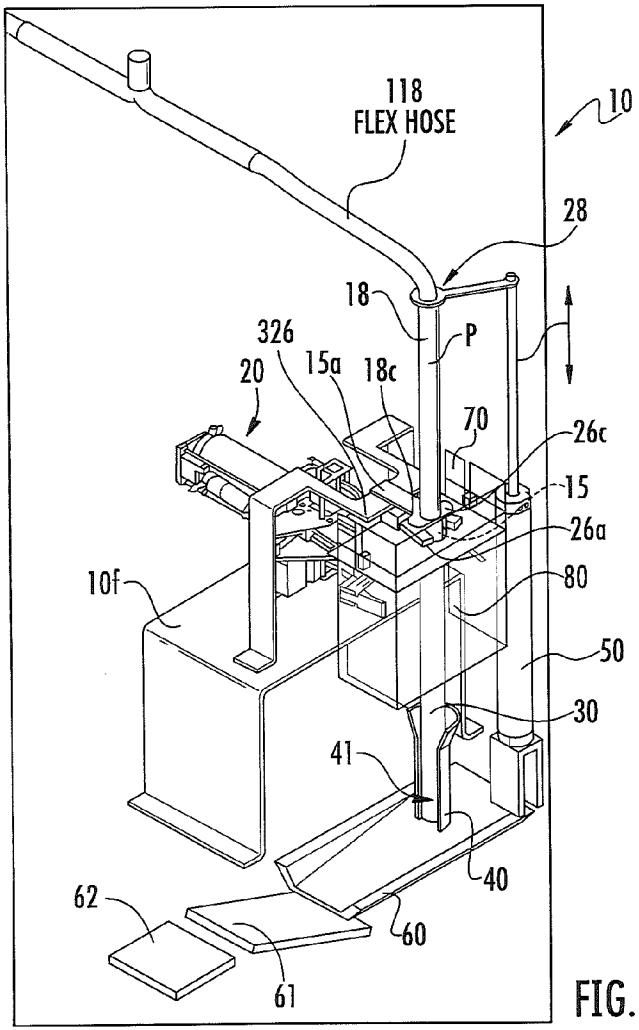
FIG. 14A is a side perspective view of another embodiment of a packaging apparatus according to embodiments of the present invention.

The sleeve drive system 50 comprises an automated or semi-automated drive system such as an electric, pneumatic or hydraulic actuator or an electric drive motor with a shaft, link, belt, cable, servos or other drive system that can move the sleeve 18 up and down during a filling operation via the attachment member 28. As shown in FIGS. 14A and 14B, the drive system 50 comprises an actuator 50*a* with a pneumatic cylinder 50*c* and a reciprocating rod 51.

The attachment member 28 can be a single attachment member or may be provided as a plurality of attachment members. In the embodiment shown in FIGS. 14A and 14B, for example, the attachment member 28 is attached to an upper portion of an actuation rod 51 that moves up and down into the actuation cylinder 50*c*. The attachment member 28 can include an arm 28*a* that is attached to the end of the rod 51 or other drive member. The arm 28*a* can have a length that is between about 1 inch to about 5 feet, typically between about 1 foot to about 3 feet. The attachment member 28 can include a yoke-like member 28*y* with a circular or semi-circular ring that at least partially encases the sleeve 18. However, other different shaped sleeve attachment members may be used.

In some embodiments, the drive system can include an actuator 50*a* that can reside closely spaced to the support frame 10*f* and/or clipper 20, typically within about 1-3 feet. The actuator 50 can be held by a support member 52 that raises the lower portion of the actuator body (e.g., cylinder) off a factory support floor. However, the actuator, where used, can also reside directly on the floor.

In some embodiments, the sleeve drive system 50 defines a sleeve fill cycle that is automated so as to move the sleeve up and down while attached to the drive system automatically with a defined stroke cycle, stroke distance, speed and synchronized timing with the clipper operation. The stroke cycle can be adjustable for different diameter bags and fillings. The stroke length and the speed can be selected by a user or defined by a recipe programmed in the control unit or other control circuit, which can define an associated rate and stroke length. The recipes can define speed and stroke distance based on the end product dimension being packaged such as the diameter and length of the desired filled shot bag. The stroke distance of the sleeve into or out of the bag may also be controlled by sensors that define a fixed position (e.g., a top of the collar or above the clipper) so that a length is known.

In some embodiments, an operator can guide the movement or the rate of movement of the sleeve during a filling operation. For example, the sleeve drive system 50 can be configured to provide physical support of the sleeve 18 so that an operator can use a "finger-touch" or "hand-touch" movements to guide and/or direct the sleeve drive to move the sleeve 18 up or down. In some embodiments, a handle or other grip that can be accessible to a user can be provided on the attachment member 28 (not shown) that allows an operator to guide the movement.

In other embodiments, an electronic push button, switch, GUI (graphic user interface) on a touch screen of a controller or other UI input in communication with the drive system 50 can be used to allow an operator to direct the sleeve 18 via member 28 to move up or down and at an adjustable or substantially constant speed. This movement can be carried out using a wireless or wired (hand) controller. The controller can be portable or movable or may be hard-mounted (directly or indirectly) on the support frame 10*f*.

In some embodiments, once a user loads a bag onto the sleeve 18 and the clamp assembly 26 engages the bag 30, the apparatus 10 (e.g., a processor associated with the control unit and/or a controller) can automatically direct the sleeve 18 to move down to a "start fill" location proximate a lower end portion of the bag 30, then direct the sleeve 18 to move upward (retract) at a defined rate or speed. The automated movement of the drive system 50 can begin upon actuation of a user input by the operator or automatically based on sensors that confirm that the bag is loaded onto the sleeve 18 via sensors that confirm proper loading.

FIGS. 14A and 14B also illustrate a vertically stationary external collar 15 that can be supported by an extension support arm 15*a* that can attach to a mounting bracket 326 attached to the support frame 10*f*. In some embodiments, an upper end of the bag 30*u* can be pulled up and over the collar, then turned down a distance over an outer surface of the collar 15.

As before, the sleeve 18 is raised above the clipper gates 22 before the clipper gates 22 are closed. After the bag 30 is filled and the sleeve 18 raised a suitable distance (the lower end of the sleeve 18*e* can still be in the upper end 30*u* of the bag, the clipper gates 22 are closed, the upper end of the bag 30*u* is pulled upward a distance D by the bag support assembly 26 while the clipper gates 22 hold a lower portion of the bag down below the clipper gates 22 to tighten the neck of the package before the clipper 20 applies one or more clips to the bag. The distance "D" can be any suitable distance that may vary by configuration and/or material of the bag 30, typically between about 0.25 inches to about 2 inches.

The support frame 10*f* can also hold the clipper 20 and a control unit 35 (FIG. 1B) which may include an HMI (Human Machine Interface) 39 and/or UI 35*i* that electronically directs the operation of certain components.

Generally stated, the control unit 35 and/or 35*i* can include a control circuit 35*c* that can direct, for example, one or more of the clipper 20, clip guard 70 that can translate up and down, locking of the bag support member 26 to the bag 30, the sleeve drive system 50, and optionally a valve or valves controlling product flow from the sleeve 18 and the like. The control unit 35 can include a control circuit 35*c* that communicates with the clipper 20 and inhibits active clip operation and/or gate 22 closure until the clip housing guard 80 is in position using electronic and/or optical sensors and the like.

The sleeve 18 and/or pipe P can be in communication with an air valve, e.g., a flow valve that can be configured to open and close when inserted into a bag 30 held by the support assembly 26. This flow valve can be triggered to open and close using an electronic control unit 35, controller or other remote or on-board control circuit and/or the flow valve may be manually-triggered or operated. The flow valve may be in the sleeve 18 or reside upstream thereof. Two or more flow control valves can be serially spaced apart along the flow path upstream and/or proximate to the discharge end of the sleeve. A plurality of valves may be used for system redundancy and safety.

As shown in FIGS. 5B, 6B, 7B and 9A, for example, the clipper 20 is configured and positioned so that the clipper gate 22 resides under the bag support assembly 26 with the clipper gate 22, when closed is substantially aligned with an axially extending centerline of the bag 30 and/or sleeve 18. The clipper 20 can be configured to translate downward to push against a portion of the contents of the bag while the upper end portion of the bag is held by the bag support assembly 26 to tighten the bag 30 before applying at least one clip, typically applying two closely spaced apart clips substantially concurrently.

In some embodiments, the clipper 20 can rise to a home position and the gate 22 (e.g., gate arms $\mathbf{22}_1$, $\mathbf{22}_2$) can open, then a filled bag can be released. The operative and home positions of the clipper 20 can be relatively closely spaced apart a vertical distance, such as between about 0.25 inches to about 10 inches, typically between about 0.5 inches and 6 inches, for example.

In some particular embodiments, an operator or an automated bag handler can be configured to push or pull the clipped bag with the filled product 30 from under the sleeve and position it on a conveyor 62 or other collection or accumulation container or device.

In some optional embodiments, an automated liner former can be integrated into the bag support assembly 26 and/or collar 15 (FIG. 15A) or an inner bag support member (where used). This liner former can be extended and used to push the liner inward before the clipper 20 is activated where an inner liner is used in the bag 30 (not shown).

In some embodiments, the clipper 20 is configured to apply a strong relatively large clip, such as, for example, a 600 or 700 series available from Tipper Tie, Inc., Apex, N.C., which are well suited for difficult packaging applications such as burlap, plastic, multi-wall laminates, shot bags, and heavy weighted packages. The clips can be metallic.

The clipper can be configured similar to or the same as the TIPPER TIE® Model F625LM or F725L clippers, which are air powered, gate actuated clippers. Built for use in any industry that needs a secure clip closure, these clippers apply the special 600 and 700 series clips. Additionally, horizontal operation allows for easier handling of large bags. One quick continuous motion can gather the bag 30 into a neck and the clipper can apply a positive, strong closure (one or more clips). Automated or semi-automated clippers are well known and include the gate 22 discussed above. See, e.g., U.S. Pat. Nos. 3,389,533; 3,499,259, 4,683,700, 5,161,347, 5,495,701, 5,586,424, 6920,728, the contents of which are hereby incorporated by reference as if recited in full herein.

Generally stated, the clipper 20 can include a clip path that directs a string of clips along a (curvilinear) rail 20*r* (FIG. 3C) to a clip window. As is well known, a punch can automatically force a forwardmost clip down the clip window and into the clip gate 22 to cooperate with a lower forming die to wrap the (at least one) clip around a trailing or leading gathered edge portion of a product package to close or seal the package. The clipper 20 can also apply two clips substantially simultaneously to an upper portion of the bag 30*u*. Generally stated, the clips are applied to the gathered packaging material to deform to wrap around and close the bag with the product therein. Examples of suitable clips include metallic generally "U"-shaped clips available from Tipper Tie, Inc., in Apex, N.C. Other clips, including elastomeric clips or other clip materials and clip configurations, may also be used.

In some embodiments, an operator can manually load each respective bag 30 onto the device 10 for subsequent filling. The bag clamp shield 70 can be stationary, at least after a bag is loaded, until after the bag is clipped. The control unit 35 can be configured to lock the shield 70 into the active position after the bag is loaded until the clipper has applied the clips, then automatically raise or open the shield to allow operator access to load another bag for filling. In some embodiments, an operator can use user inputs 35*i* on the machine to cause the shield to move to an active position. If the shield 70 is not in position, then the device 10 can be configured so that filling is not allowed (e.g., a flow valve can be closed or a main air valve deactivated or at least not activated for filling).

Figure 15B:
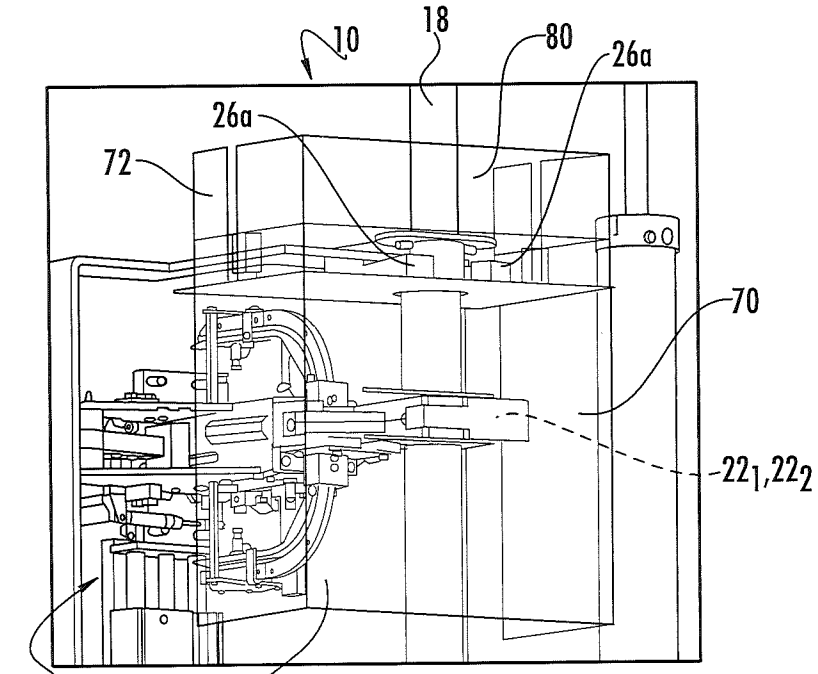
FIG. 15B is another partial front perspective view of the embodiment shown in FIG. 15A illustrating a different position of two cooperating translatable shields according to embodiments of the present invention.
Figure 15A:
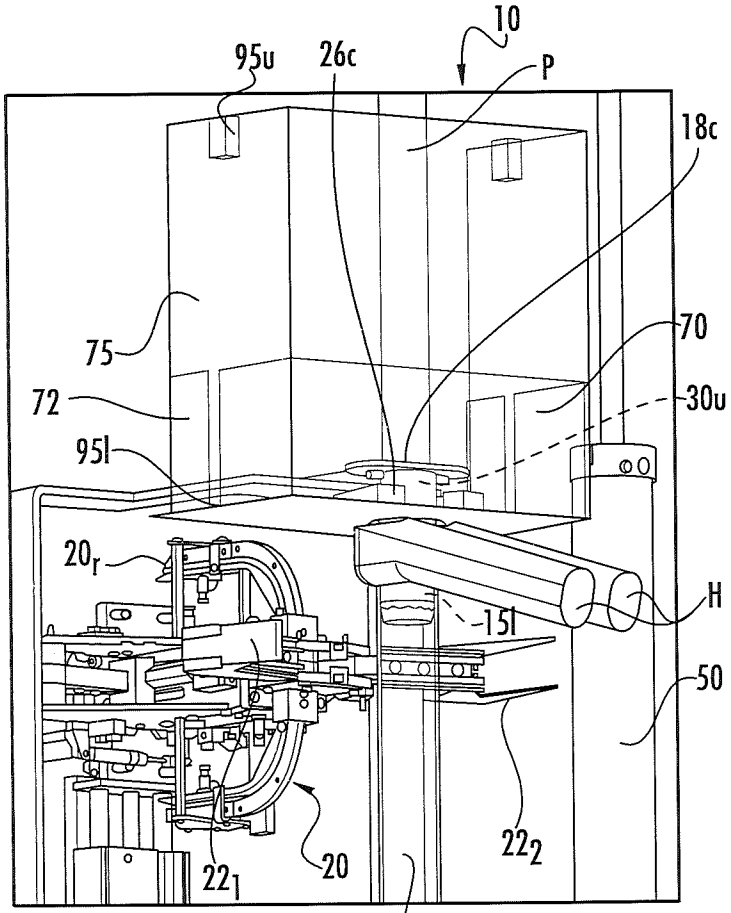
FIG. 15A is a partial front perspective view of yet another packaging apparatus according to embodiments of the present invention.

FIGS. 14A, 14B, 15A and 15B also illustrate different configurations of the front guard 70. In this embodiment, the shield 70 can include two cooperating independently vertically movable shields 72, 75. The first shield can be a clipper shield 75 that is be longer than the second bag shield 72. One or more optical and/or electrical sensors 95 attached to one or both of the shields/guards 72, 75 can be used to electronically assess whether the appropriate shield is in position. As shown in 15A, the sensors 95 can include upper 95*u* and lower 95*l* cooperating portions that abut each other when the clipper guard is in position for the clipper operation (FIG. 15B) and that are spaced apart when the clipper is inactive during filling (FIG. 15A). Other housing guards and sensor configurations can be used. For example, the clipper guard and housing guard can be a single guard that opens to allow bag loading, then closes and is not required to translate up and down. In some embodiments, the housing guard(s) can both be stationary with window or door access, as appropriate.

The bag 30 can be configured to frictionally engage the sleeve 18 during a pre-fill loading of the bag onto the sleeve 18. The bag 30 can also be attached to the sleeve 18 using external clamps during the preliminary bag loading operation. In other embodiments, the bag 30 is attached to a bag support assembly 26 on the apparatus and the sleeve 18 is subsequently attached to the bag. In some embodiments, the bag 30 is not required to be attached to the sleeve 18, but can be configured to allow the sleeve to travel a distance into the bag, then retract upward during filling.

It is also contemplated that automated bag loaders may be used to further automate the device 10. This may be facilitated using a robotic arm that releasably attaches the bags to the bag support member 26 and/or collar 15 for subsequent filling and clipping. A series of collars 15 and/or clamp assemblies 26*c* can be provided in an endless loop and a robotic arm or other member (or even operator) can load the bags onto respective collars that can then be rotated through an active filling position (not shown).

Where used for hazardous materials such as explosives or blasting materials are being packaged, the device 10 can be configured to comply with Hazards Analysis and Operability Standards (HAZOP).

Figure 16:
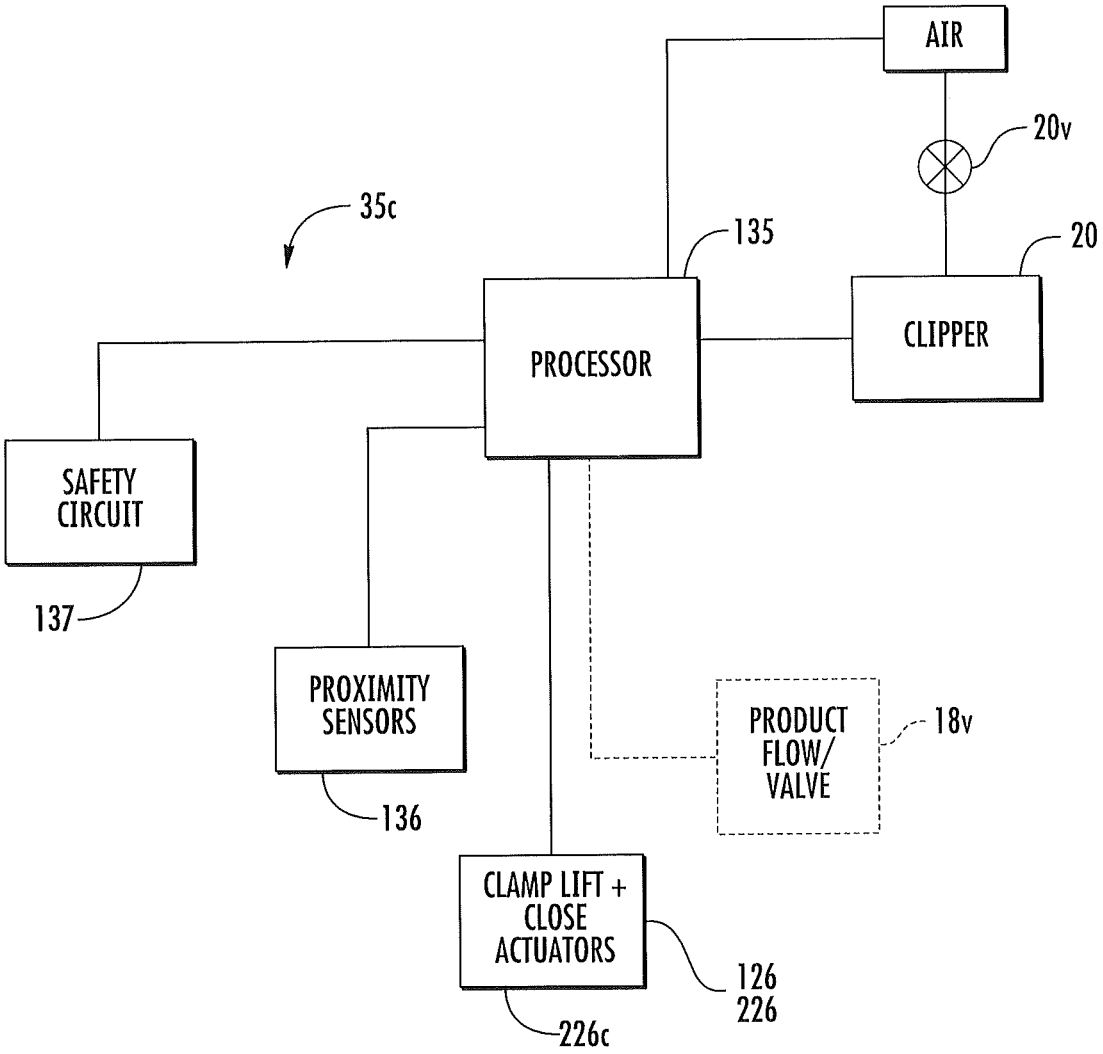
FIG. 16 is a block diagram of a control circuit according to embodiments of the present invention.

FIG. 16 is a block diagram of an exemplary control circuit 35*c* according to embodiments of the present invention. The circuit 35*c* can include at least one processor 135 that communicates with safety and fill detection sensors 136 and clamp lift and close actuators 126, 226 (and 218) for example, as well as the clipper 20, the safety circuit 137 and product support member 40. The control circuit 35*c* can synchronize the operation so that defined workflow steps are automatically carried out efficiently in a defined order, e.g., the actuators move to laterally extend the clamps to close against the bag, then the front shield moves down, the safety circuit is monitored, the clipper air valve 20*v* is activated after the shield 70 is in position, the clamp lift actuators retracts the rods to raise the bag clamp assembly before the clipping occurs, then the clipper is fired. The at least one processor of the control circuit 35*c* can be the controller or in communication with the controller.

Figure 17:
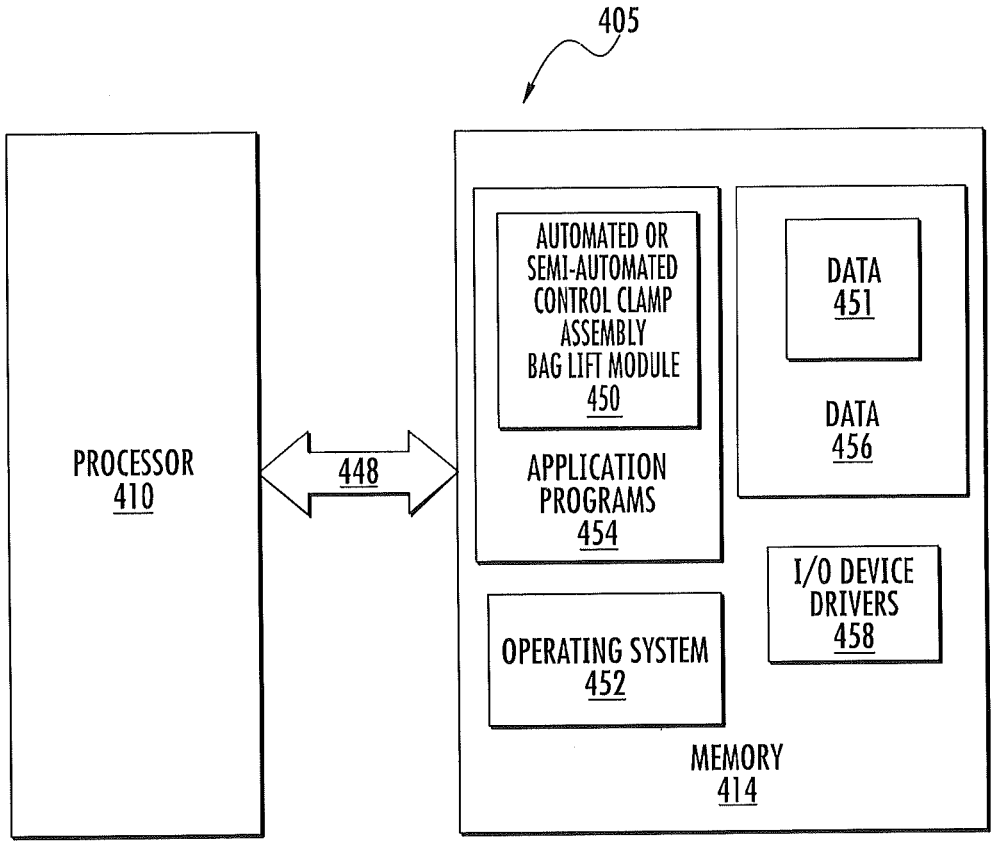
FIG. 17 is a block diagram of a data processing system according to embodiments of the present invention.

FIG. 17 is a block diagram of exemplary embodiments of data processing systems that illustrates systems, methods, and computer program products in accordance with embodiments of the present invention. The processor 410 communicates with the memory 414 via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

As shown in FIG. 17, the memory 414 may include several categories of software and data used in the data processing system 405: the operating system 452; the application programs 454; the input/output (I/O) device drivers 458; the Automated or Semi-Automated Synchronized Control Module for the and Clamp Assembly 450; and the data 456.

The data 456 may include a look-up chart of different "recipes" as well as a defined workflow order of various components as described above, including the bag clamp cylinders, the clamp lift cylinders and the loading sleeve lift cylinder, which may optionally be configured to correspond to particular or target products, pipe sizes and the like.

As will be appreciated by those of skill in the art, the operating system 452 may be any operating system suitable for use with a data processing system, such as OS/2, AIX, DOS, OS/390 or System390 from International Business Machines Corporation, Armonk, N.Y., Windows CE, Windows NT, Windows95, Windows98 or Windows2000 from Microsoft Corporation, Redmond, Wash., Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 414 components and/or the dispensing system 420. The application programs 454 are illustrative of the programs that implement the various features of the data processing system 405 and preferably include at least one application which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the Module 450 being an application program in FIG. 17, as will be appreciated by those of skill in the art, other configurations may also be utilized while still benefiting from the teachings of the present invention. For example, the Module 450 may also be incorporated into the operating system 452, the I/O device drivers 458 or other such logical division of the data processing system 405. Thus, the present invention should not be construed as limited to the configuration of FIG. 20, which is intended to encompass any configuration capable of carrying out the operations described herein.

The I/O data port can be used to transfer information between the data processing system 405 and the control unit 35, lift actuators 218, 226, and clamp actuators 126, drive system 50 (where used), the clipper 20 or another computer system over a network (e.g., the Internet or Ethernet) or to other devices controlled by a processor associated with the control unit 35 or processor 135. These components may be conventional components such as those used in many conventional data processing systems which may be configured in accordance with the present invention to operate as described herein.

While the present invention is illustrated, for example, with reference to particular divisions of programs, functions and memories, the present invention should not be construed as limited to such logical divisions. Thus, the present invention should not be construed as limited to the configuration of FIG. 17 but is intended to encompass any configuration capable of carrying out the operations described herein.

The operation and sequence of events and can be controlled by a programmable logic controller (PLC). The operational mode and certain input parameters or machine controls can be selected or controlled by an operator input using a Human Machine Interface (HMI) to communicate with the controller and/or control unit as is well known to those of skill in the art.

The block diagram illustrates the architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A packaging apparatus comprising:

a clipper having clipper gates that close together;

a bag clamp assembly that is in cooperating alignment with and that resides above the clipper gates, the bag clamp assembly configured to releasably hold a respective bag in the apparatus, the bag clamp assembly comprising a flow channel, wherein the bag clamp assembly is configured to releasably attach to an upper end portion of a bag to hold the bag for filling with target material through the flow channel; and a controller in communication with the clipper and bag clamp assembly, wherein the controller is configured to: (i) direct the bag clamp assembly to clamp the bag in position prior to filling, (ii) direct the clipper gates to close against an upper end portion of a respective bag after the bag has a desired amount of target material, then (iii) direct the clipper to apply at least one clip to the upper end portion of the bag while the clipper gates are closed, wherein the apparatus includes at least one lift actuator in communication with a respective bag held by the bag clamp assembly, wherein the controller is configured to direct the at least one lift actuator to pull an upper portion of the bag upward while the clipper gates are closed.

2. The apparatus of claim 1, wherein the controller is configured to direct the clipper to travel up or down after the clipper gates are closed prior to a applying the at least one clip.

3. The apparatus of claim 1, wherein the at least one lift actuator is a plurality of vertically translating lift actuators, wherein the bag clamp assembly is configured to hold the lift actuators, and wherein the bag clamp assembly further comprises laterally extending bag clamp actuators and a center tube, wherein the center tube defines the flow channel, wherein the bag clamp actuators laterally extend toward each other to cause respective clamp members to clamp against the center tube to clamp a wall of the bag therebetween, and wherein the controller is configured to direct the lift actuators to raise the bag clamp assembly a distance while the clip gates are closed.

4. The apparatus of claim 1, further comprising a sleeve that slidably extends a distance down into the bag through the flow channel and translates between upper and lower positions, wherein, the lower position is a bag loading position, and wherein the controller is configured to automatically raise the sleeve above the clipper gates to the upper position before closing the clipper gates prior to a clipping operation.

5. The apparatus of claim 4, further comprising a sleeve collar that is connected to the sleeve, the sleeve collar attached to a sleeve lift actuator, wherein the controller is in communication with the sleeve lift actuator, and, for a respective bag filling operation, directs the sleeve lift actuator to lower the sleeve to the loading position, then directs the sleeve lift actuator to automatically lift the sleeve above the clipper gates.

6. The apparatus of claim 4, further comprising a pipe that slidably engages the sleeve so that the sleeve can translate up and down relative to the pipe during a bag filling operation.

7. The apparatus of claim 6, wherein the sleeve comprises an air inlet extending through at least one outer wall segment, the air inlet configured to reside inside a respective bag prior to a filling operation, then above the bag with the pipe wall occluding the air inlet during the filling operation while flowable material travels through the sleeve into the bag.

8. The apparatus of claim 1, further comprising a housing holding the clipper and bag clamp assembly, wherein the bag clamp assembly comprises laterally extending bag clamp actuators with grip members that reside across from each other with the flow channel extending between them, wherein the laterally extending clamp actuators are configured to extend to cause the grip members to clamp against a rigid member that defines the flow channel thereby snugly holding the bag therebetween.

9. The apparatus of claim 1, further comprising a substantially vertically oriented sleeve or pipe residing in the bag clamp assembly flow channel with a lower end of the sleeve or pipe configured to reside in the flow channel in the bag held by the bag clamp assembly, wherein the bag is oriented to be held substantially vertically by the bag clamp assembly, and wherein the sleeve or pipe is configured to automatically translate between a bag loading position that is below the clipper gates to a pre-clip position that is above the clipper gates.

10. The apparatus of claim 1, wherein the bag clamp assembly comprises clamp members that releasably attach serially interchangeable different size grip members.

11. The apparatus of claim 1, further comprising a sleeve slidably engaged to a pipe, wherein the sleeve resides in the bag clamp assembly flow channel inside the bag during a filling operation, wherein the bag clamp assembly comprises bag clamp members with interchangeable grip members, and wherein the apparatus is configured to serially interchangeably mount different size sleeves, pipes and grip members.

12. The apparatus of claim 1, further comprising a housing enclosing the clipper and bag clamp assembly with a front shield attached to an actuator that automatically moves up and down to allow access to the bag clamp assembly.

13. The apparatus of claim 6, further comprising:

a housing enclosing the clipper and bag clamp assembly; and a lower holding member that resides under a respective bag in-line with the sleeve and pipe.

14. The apparatus of claim 1, further comprising a sleeve slidably engaged to a pipe that is adapted to be in fluid communication with a supply of pumpable flowable material, wherein the sleeve resides in the bag clamp assembly flow channel inside the bag during a filling operation, wherein the bag clamp assembly comprises a center tube that defines the flow channel, and wherein the bag clamp assembly comprises first and second laterally extendable clamps that are configured to close against an outer wall of the tube while the sleeve slidably extends through the flow channel of the center tube.

15. The apparatus of claim 1, further comprising a sleeve slidably engaged to a pipe that is adapted to be in fluid communication with a supply of pumpable material, the sleeve configured to reside in an upper end of the bag during a filling operation, wherein the bag clamp assembly comprises:

upper and lower horizontally oriented platforms that are attached to each other and reside above the clipper gates that define a laterally extending space therebetween;

a vertically oriented tube defining the flow channel held by the upper platform;

first and second bag clamp actuators with rods that reside in the laterally extending space between the upper and lower platforms, the bag clamp actuators configured to translate substantially horizontally to move first and second clamp members between clamp and release positions, wherein the first and second clamp members include grip segments that clamp against a bag held against an outer wall of the tube; and first and second bag clamp assembly lift actuators attached to the upper platform as the at least one lift actuator configured to pull against the bag when the clipper gates are closed.

16. The apparatus of claim 1, wherein the controller is configured to operate the clipper so that operation (ii) is carried out to direct the clipper gate to close against an upper end portion of a respective filled bag, then before directing the clipper to apply the at least one clip per operation (iii), the controller directs the clipper to translate a distance downward against the upper end portion of the respective filled bag, then the controller directs operation (iii) so that the clipper applies two clips substantially concurrently to the upper end portion of the filled bag , and then the controller directs the clipper gates to open to release the clipped bag.

* * * * *

UNITED STATES PATENT AND TRADEMARK OFFICE

CERTIFICATE OF CORRECTION

PATENT NO. : 8,833,041 B2
APPLICATION NO. : 13/742848
DATED : September 16, 2014
INVENTOR(S) : May et al.

It is certified that error appears in the above-identified patent and that said Letters Patent is hereby corrected as shown below:

On Title Page:
Item [74], *Attorney, Agent, or Firm*:
Please correct "Myer Bigel Sibley & Sajovec, P.A."
to read -- Myers Bigel Sibley & Sajovec, P.A. --

Signed and Sealed this
Twenty-seventh Day of January, 2015

Michelle K. Lee

Michelle K. Lee
*Deputy Director of the United States Patent and Trademark Office*